US012733752B2

(12) United States Patent
Lange et al.

(10) Patent No.: US 12,733,752 B2
(45) Date of Patent: Sep. 15, 2026

(54) APPARATUSES, METHODS, AND KITS FOR A CHILD ACTIVITY CENTER

(71) Applicant: Graco Children's Products, Inc., Atlanta, GA (US)

(72) Inventors: Eric A. Lange, Atlanta, GA (US); David Thomas Hotard, Peachtree Corners, GA (US); Amanda Margaret Hadley, Wilmington, DE (US)

(73) Assignee: Graco Children's Products, Inc., Atlanta, GA (US)

( * ) Notice: Subject to any disclaimer, the term of this patent is extended or adjusted under 35 U.S.C. 154(b) by 462 days.

(21) Appl. No.: 18/349,663

(22) Filed: Jul. 10, 2023

(65) Prior Publication Data

US 2024/0016306 A1 Jan. 18, 2024

Related U.S. Application Data

(60) Provisional application No. 63/368,245, filed on Jul. 12, 2022.

(51) Int. Cl.

| | |
|---|---|
| ***A47D 1/00*** | (2006.01) |
| ***A47D 15/00*** | (2006.01) |
| *A47D 13/10* | (2006.01) |

(52) U.S. Cl.

CPC ..... *A47D 1/002* (2013.01); *A47D 15/006* (2013.01); *A47D 13/101* (2022.08); *A47D 13/107* (2013.01)

(58) Field of Classification Search

CPC .. A47D 13/101; A47D 13/105; A47D 13/102; A47D 13/107; A47D 1/002

See application file for complete search history.

(56) References Cited

U.S. PATENT DOCUMENTS

| | | | | |
|---|---|---|---|---|
| 5,503,458 | A * | 4/1996 | Petrie | A47D 13/101 297/51 |
| 7,673,934 | B2 | 3/2010 | Bearup et al. | |
| 8,070,617 | B2 | 12/2011 | Barron et al. | |
| 8,746,794 | B2 | 6/2014 | Oren et al. | |
| 8,992,283 | B2 | 3/2015 | Piwko, Jr. et al. | |
| 9,370,257 | B2 | 6/2016 | Roberts et al. | |
| 9,918,561 | B2 | 3/2018 | Perrin et al. | |
| 11,019,938 | B2 | 6/2021 | Taylor et al. | |
| 11,344,137 | B1 | 5/2022 | Jaffre et al. | |
| 2011/0127810 | A1* | 6/2011 | Lee | A47D 13/101 297/16.1 |
| 2021/0401190 | A1 | 12/2021 | Tyneski et al. | |

FOREIGN PATENT DOCUMENTS

| | | |
|---|---|---|
| CN | 209518622 U | 10/2019 |
| WO | 2022155408 A1 | 7/2022 |

* cited by examiner

*Primary Examiner* — Syed A Islam

(74) *Attorney, Agent, or Firm* — Eversheds Sutherland (US) LLP

(57) ABSTRACT

A child activity apparatus may include a base, and a frame coupled to the base. The frame includes a horizontal bar extending between a pair of opposing side bars. The side bars are rotatably secured to the base. The frame is movable relative to the base. The frame is configured to receive a seat. The apparatus may include the seat. A method of assembling the apparatus for the child activity center may include securing the frame to the base, and optionally, further securing the seat to the frame. A kit for a child activity center may include the frame, the base, and at least one seat. The at least one seat may include a first seat and a second seat.

17 Claims, 23 Drawing Sheets

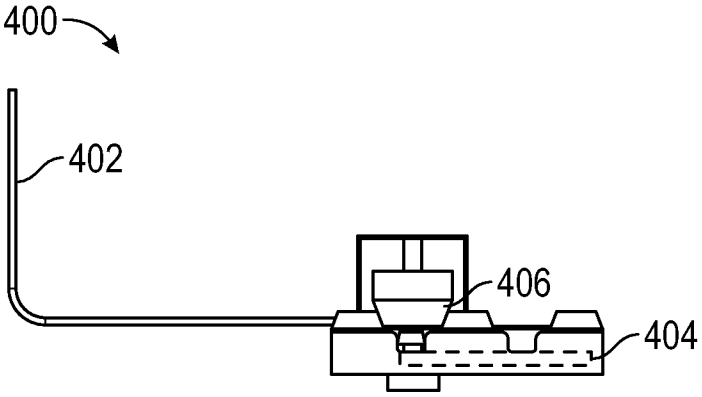
FIG. 7A
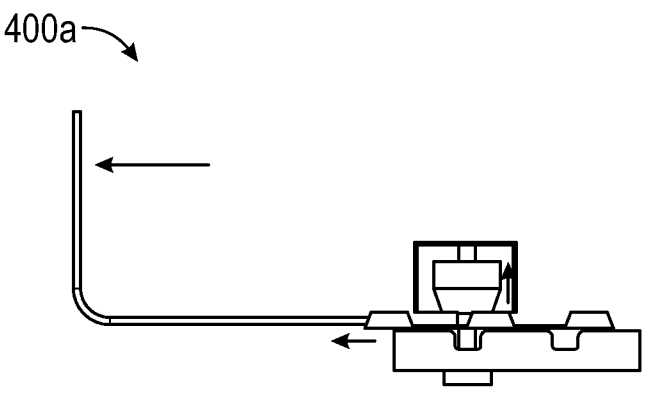
FIG. 7B
FIG. 7C
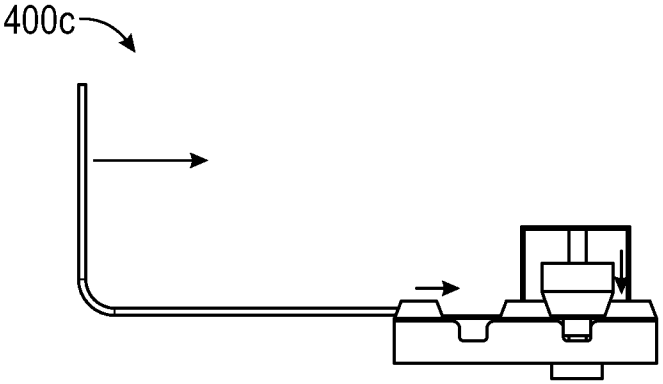
FIG. 7D

APPARATUSES, METHODS, AND KITS FOR A CHILD ACTIVITY CENTER

CROSS-REFERENCE TO RELATED APPLICATION

This application claims the benefit of U.S. Provisional Application No. 63/368,245, filed Jul. 12, 2022, the entirety of which is hereby incorporated by reference.

TECHNICAL FIELD

The present disclosure is generally directed to an activity center for children, and more particularly to apparatuses, methods, and kits for a child activity center.

BACKGROUND

A children may use an activity center for play, leisure, or rest. For example, different types of child furniture are available, such as bouncers, floor seats, play spots, or toddler seats. Through a child's day, or as the child grows, the child may prefer to engage in different activities or modes of rest or play. These different units of furniture occupy space that could be used for other purposes, and require separate maintenance, inspection, and cleaning.

SUMMARY

The present disclosure is generally directed to an activity center for children, and more particularly to systems, methods, and kits for a child activity center. In embodiments, the present disclosure describes a convertible child activity apparatus. The apparatus includes a base, and a frame coupled to the base. The frame includes a horizontal bar extending between a pair of opposing side bars. The side bars are rotatably secured to the base. The frame is movable relative to the base. The frame is configured to receive a seat. In embodiments, the apparatus includes the seat.

In embodiments, the present disclosure describes a child activity apparatus. The apparatus may include a base and a frame coupled to the base. The frame may include a horizontal bar extending between a pair of opposing side bars, the side bars being secured to the base. The apparatus may further include a seat removably secured to the frame. The seat may include a seat cover including a back portion extending along the frame between the side bars. The seat cover may further include a seat base.

In embodiments, a method of assembling an apparatus for a child activity center includes securing the frame to the base.

In embodiments, a kit for a child activity center includes the frame, the base, and at least one seat. In some embodiments, the at least one seat includes a first seat and a second seat.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

FIG. 7A is a conceptual partial side view of an adjustable coupling assembly in a first configuration.

FIG. 7B is a conceptual partial side view of the assembly of 7A in a second configuration.

FIG. 7C is a conceptual partial side view of the assembly of 7A in a third configuration.

FIG. 7D is a conceptual partial side view of the assembly of 7A in a fourth configuration.

Figure 1B:
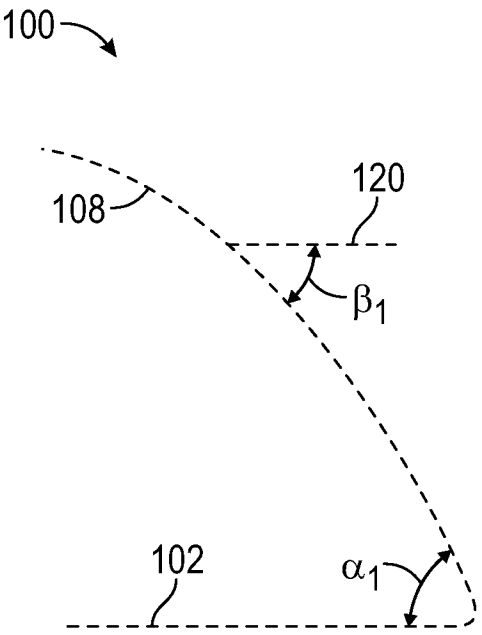
FIG. 1B is a conceptual view of angles between various components of the apparatus in the first configuration of FIG. 1A.

The present disclosure provides a more detailed and specific description with reference to the accompanying drawings. The drawings and specific descriptions of the drawings, as well as any specific or other embodiments discussed, are intended to be read in conjunction with the entirety of this disclosure.

DETAILED DESCRIPTION

Example embodiments will now be described more fully hereinafter with reference to the accompanying drawings, in which example embodiments are shown. The concepts disclosed herein may, however, be embodied in many different forms and should not be construed as limited to the example embodiments set forth herein; rather, these embodiments are provided so that this disclosure will be thorough and complete, and will fully convey the scope of the concepts to those skilled in the art. Like numbers refer to like, but not necessarily the same or identical elements throughout.

The present disclosure relates to, among other things, apparatuses, methods, and kits for a child activity center. In embodiments, apparatuses for a child activity center, for example, a convertible child activity center, are described. In other embodiments, methods for assembling and using a convertible children activity center are described. In other embodiments, kits for a convertible child activity center are described.

The term "activity" refers to modes of use, and does not necessarily require that an occupant of an apparatus or system according to the present disclosure be engaged in performing an activity. For example, resting, sleeping, bouncing, playing, eating, or any other active or passive mode of use by a child is an activity in the present disclosure.

The present disclosure is generally directed to an activity center for children, and more particularly to systems, methods, and kits for a child activity center. In embodiments, the present disclosure describes a convertible child activity apparatus. The apparatus includes a base, and a frame coupled to the base. The frame includes a horizontal bar extending between a pair of opposing side bars. The side bars are rotatably secured to the base. The frame is movable relative to the base. The frame is configured to receive a seat. In embodiments, the apparatus includes the seat.

In embodiments, the present disclosure describes a child activity apparatus. The apparatus may include a base and a frame coupled to the base. The frame may include a horizontal bar extending between a pair of opposing side bars, the side bars being secured to the base. The apparatus may further include a seat removably secured to the frame. The seat may include a seat cover including a back portion extending along the frame between the side bars. The seat cover may further include a seat base.

In embodiments, a method of assembling an apparatus for a child activity center includes securing the frame to the base.

In embodiments, a kit for a child activity center includes the frame, the base, and at least one seat. In some embodiments, the at least one seat includes a first seat and a second seat.

Figure 1A:
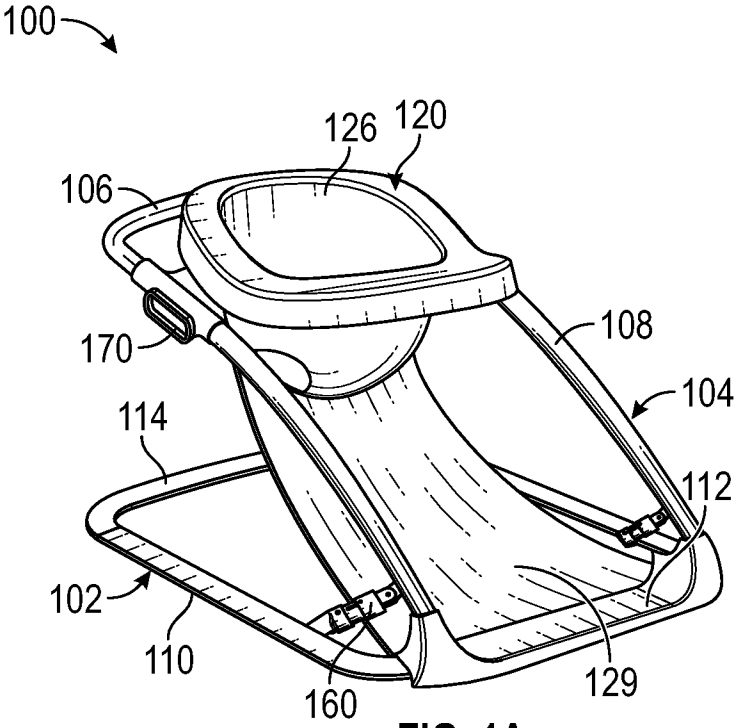
FIG. 1A is a conceptual perspective view of a child activity apparatus in a first configuration.

FIG. 1A is a conceptual perspective view of a child activity apparatus 100 in a first configuration. FIG. 1B is a conceptual view of angles between various components of the apparatus in the first configuration 100 of FIG. 1A. The apparatus 100 includes a base 102, and a frame 104 coupled to the base 102. The frame 104 includes a horizontal bar 106 extending between a pair of opposing side portions 108. The side portions 108 may be side bars or other members, such as contiguous or non-contiguous members. The frame 104 may be u-shaped. The frame 104 may be tubular, or substantially tubular. For example, the frame 104 may be formed by bending, welding, joining, or forming one or more tubular sections. In some embodiments, the frame 104 consists of a unitary tubular portion formed in a single piece.

The side bars 108 are rotatably secured to the base 102. In some embodiments, the frame 104 consists of or consists essentially of the horizontal bar 106 extending between the side bars 108.

The side bars 108 may be curved, as shown in FIG. 1A. Providing side bars 108 that curve toward the base 102 may promote stability, for example, by situating a center of gravity in the presence of the occupant in an acceptable geometric location. The curvature may also promote compactness of the apparatus, and provide strength. Alternatively, the side bars 108 may extend along a line, a partially curved path, or any combination of linear and curved path portions Like the side bars 108, the horizontal bar 106 may also be curved or contoured, or follow another path described with reference to the side bars 108. In some embodiments, the horizontal bar 106 smoothly transitions between the side bars 108. Such a smooth transition may facilitate ergonomic use, and provide a comfortable feel during use of the apparatus 100.

The base 102 may be integrally formed as a single piece, or may include one or more pieces that are bent, welded, joined, or otherwise formed into a predetermined shape. In some embodiments, the base 102 includes a pair of opposing base side bars 110 coupled between a front portion 112 and a base rear portion 114. The front portion 112 may be a base front bar or other type of member. The rear portion 114 may be a base rear bar or other type of member.

The base 102 or the frame 104 may include one or more of a metal, an alloy, a plastic, a composite material, or any other suitable material, or combinations thereof. The base 102 and the frame 104 may include the same or similar materials, or differ in material and construction.

The frame 104 is configured to receive a seat 120. In some embodiments, the apparatus 100 further includes the seat 120 secured to the frame 104. For example, the seat 120 may not be directly supported by the base 102, and may be spaced from the base 102. Thus, the weight of an occupant in the seat 120 may be supported by the frame 104, and indirectly may be supported by the base 102 via the coupling of the frame 104 to the base. In some embodiments, the seat 120 is secured between the side bars 108.

In some embodiments, the seat 120 is spaced from the horizontal bar 106. Thus, the seat 120 may not be directly supported by the horizontal bar 106, and may instead only be supported by the side bars 108.

For example, the seat 120 may extend in a generally horizontal direction. In embodiments, the seat 120 may be user attachable or replaceable. In some embodiments, as described throughout the disclosure, a user may be provided with different types of seats, and the user may use an appropriate type of seat with the apparatus depending on a mode of use.

The frame 104 is movable relative to the base 102. For example, the frame 104 may be movable between a lower activity position (shown in FIG. 1A) and an upper activity position (shown in FIG. 2A). In the lower activity position of the first configuration 100, the apparatus may be useful for a first activity, for example, as a floor seat. In the lower activity position, the apparatus 100 may define a first angle $\alpha_1$ between the side bars 108 and the base 104, as shown in FIG. 1B. Thus, the apparatus 100 may be a convertible child activity center apparatus.

Figure 2B:
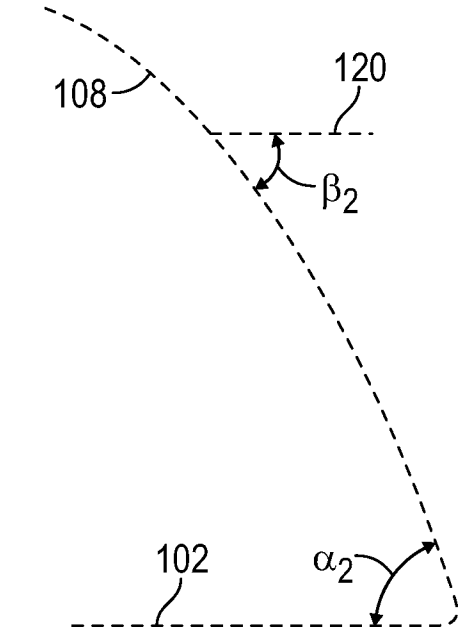
FIG. 2B is a conceptual view of angles between various components of the apparatus in the second configuration of FIG. 2A.
Figure 2A:
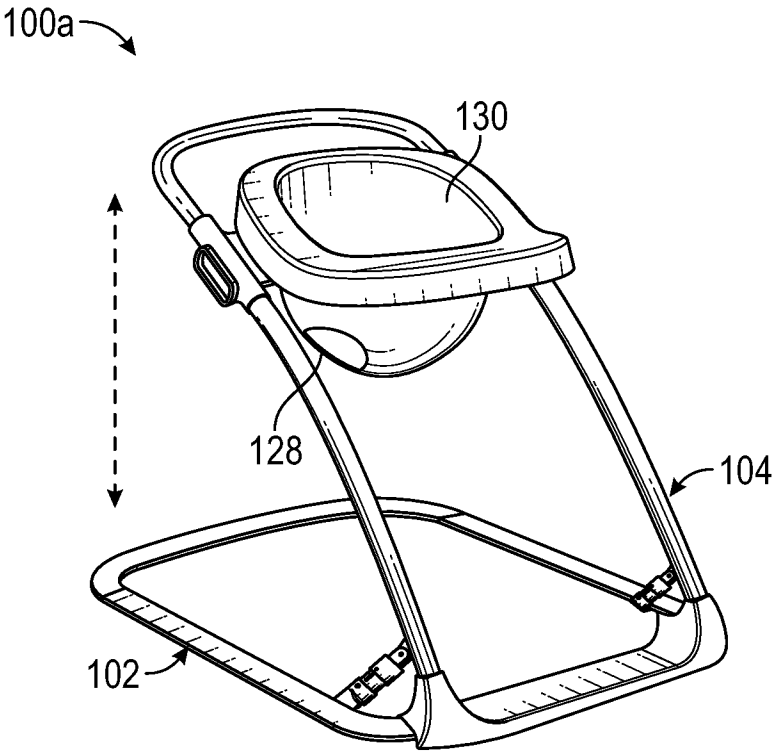
FIG. 2A is a conceptual perspective view of the apparatus of FIG. 1A in a second configuration.

FIG. 2A is a conceptual perspective view of the apparatus of FIG. 1A in a second configuration 100*a*. FIG. 2B is a conceptual view of angles between various components of the apparatus in the second configuration 100*a* of FIG. 2A. In the second configuration 100*a* shown in FIG. 2A, the apparatus is in an upper activity position. In the upper activity position, the apparatus 100*a* may define a second angle $\alpha_2$ between the side bars 108 and the base 104, as shown in FIG. 2B. The second angle $\alpha_2$ is greater than the first angle $\alpha_1$.

In the configuration 100*a*, the apparatus may be used as a jumper, the seat 120 being somewhat raised from the floor. For example, an occupant may jump in the seat 120, and the seat 120 may move toward and away from the base 102, and ultimately, from the floor on which the base 102 rests.

A user may change the configuration of the apparatus from the lower position of FIG. 1A to the upper position of FIG. 2A by pulling the frame 104, for example, by pulling the horizontal bar 106 or the side bars 108 up and away from the base 102. The apparatus is stable in both the upper and lower positions, unless moved by the user.

In some embodiments, the apparatus further includes a releasable locking mechanism to lock the apparatus in the respective first and second configurations 100 and 100*a*.

The same seat 120 may be used in both the first and second configurations 100 and 100*a*. Thus, the only substantial change between these configurations may be the relative position of the frame 104 to the base 102.

However, when the frame 104 is moved away from the base 102 to change from the lower configuration to the upper configuration, the seat 120 may no longer remain in a substantially horizontal position. To accommodate the change in orientation, the seat 120 may be pivotably or rotatably secured between the side bars 108. Thus, the seat 120 may automatically rotate under the weight of the occupant or under the weight of the seat 120 itself as the frame 104 is moved relative to the base 102, or the user may rotate the seat to an appropriate orientation. For example, in the first configuration 100, the seat 120 may define a first angle $\beta_1$ relative to the side bars 108, and in the second configuration 100*a*, the seat 120 may define a second angle $\beta_2$ relative to the side bars 108. The second angle $\beta_2$ is greater than the first angle $\beta_1$. Thus, the seat 120 may be rotatably secured between the side bars 108 to maintain a substantially horizontal orientation in each of the lower activity position and the upper activity position.

If the side bars 108 extend along a straight line, then the angles $\beta_1$ and $\beta_2$ would respectively be the same as the angles $\alpha_1$ and $\alpha_2$. However, when the side bars 108 are curved or follow a non-linear or a composite path, the angles $\beta_1$ and $\beta_2$ may differ from the angles $\alpha_1$ and $\alpha_2$.

In some embodiments, the seat 120 includes a child restraint extending across the seat, for example, a seat belt, or a harness.

The seat 120 may include a seat tray 122 defining an opening 124 (shown in FIG. 6A) for receiving an occupant. The seat tray 122 may be a toy station or any other seat attachment or support surface. The seat 120 may further include a cover 126 secured to the seat tray 122. The cover 126 may be formed of any appropriate material, such as a liner, a fabric, a non-woven material, a mat, a batting, a composite, or combinations thereof. In embodiments, the cover 126 is soft and pliable. The cover 126 may include a reinforcing member or members.

In some embodiments, the cover 126 itself is formed as a bucket secured to the seat tray 122. For example, a peripheral portion of the cover 126 may be secured around the opening 124, with a central portion of the cover 126 extending into the opening 124 to form the bucket. In the some such embodiments, the bucket defines two leg openings 128. In some embodiments, the bucket may be formed as a separate element coupled to the cover 126 or to the seat tray 122. For example, only the bucket may be provided in the seat 120, without the cover 126. The bucket may be formed or shaped by a plastic substrate or other suitable rigid substrate. In embodiments, the seat 120 (or the seat tray 122) comprises a backrest 130. The backrest 130 be formed or shaped by a plastic substrate or other suitable rigid substrate.

In some embodiments, the apparatus 100 may further include a support sheet 129, extending from a rear of the seat 120 toward a front of the base 102. The support sheet 129 may be formed of a similar material as described with reference to the cover 126 of the seat 120.

While a bucket-type seat may be used, as described with reference to FIGS. 1A and 2A, other types of seats may alternatively be used, as described with reference to FIGS. 3 and 4. For example, the bucket-type seat may be removed by a user, and replaced with another type of seat. Providing a different type of seat may provide further modes of use, for example, for other activities.

Figure 3:
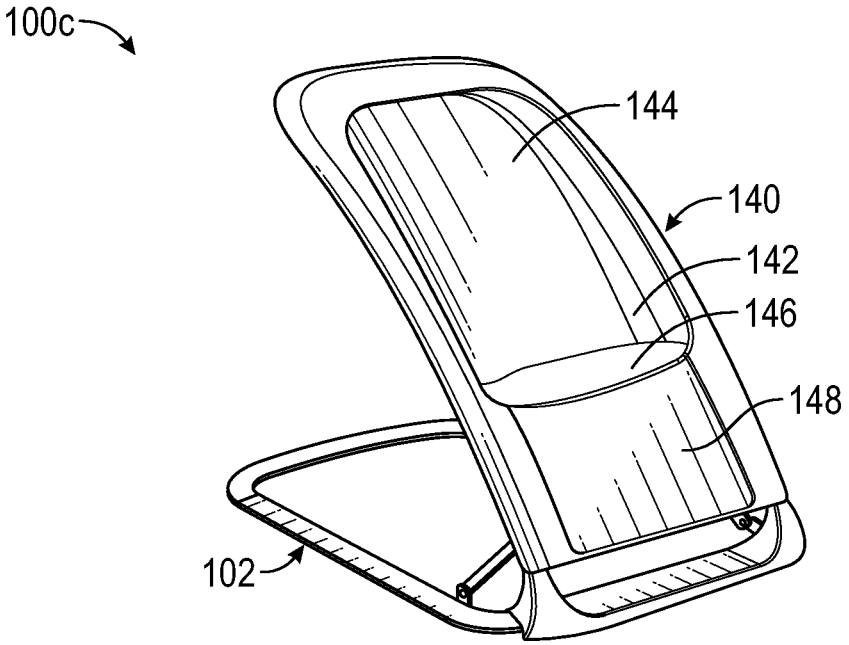
FIG. 3 is a conceptual perspective view of the apparatus of FIG. 1A in a third configuration.

FIG. 3 is a conceptual perspective view of the apparatus of FIG. 1A in a third configuration 100*b*. In the third configuration 100*b*, the apparatus includes a different seat 140. The seat 140 may include a seat cover 142 secured to the frame 104 (not visible in FIG. 3). The seat cover 142 includes a back portion 144 extending along the frame 104 between the side bars 108 (not visible in FIG. 2). The seat cover 142 may further include a seat base 146. In some embodiments, the seat cover 142 further includes a leg rest portion 148 extending between the side bars 108 and from the seat base 146 toward the base 102 of the apparatus 100*b*.

While the back portion 144, the seat base 146, and the leg rest portion 148 may be formed as portions of the cover 142 itself, in other embodiments, these components may be separately formed and joined or coupled together, or covered with the cover 142 to form the seat 140.

In some embodiments, the seat 140 can be slid downward beginning from the frame 104 toward the base 102 to secure the seat 140 to the frame (similar to a glove being slid over a hand), and can be removed using a reverse movement.

In the third configuration 100*b*, the apparatus may be usable as a toddler seat.

Figure 4:
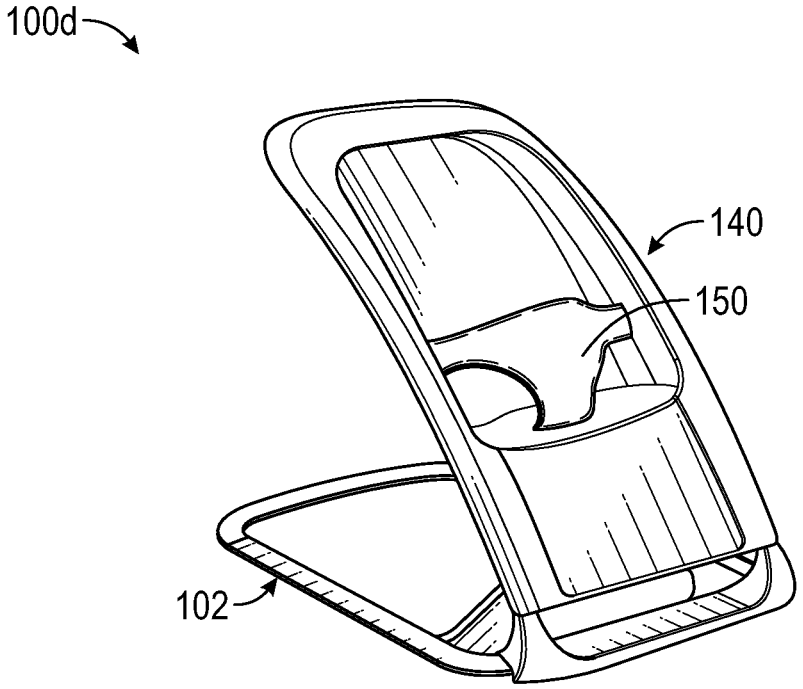
FIG. 4 is a conceptual perspective view of the apparatus of FIG. 1A in a fourth configuration.

FIG. 4 is a conceptual perspective view of the apparatus of FIG. 1A in a fourth configuration 100*c*. In the fourth configuration, the apparatus includes the same or similar seat 140 as described with reference to FIG. 3, but further including a harness 150. For example, the user may removably secure the harness 150 across the seat 140. The harness 150 may be secured by one or more of a clip, a hook-loop fastener, or any other suitable fastening mechanism. In some embodiments, the harness 150 is permanently attached to the seat 140. In the fourth configuration 100*c*, the apparatus may be usable as a bouncer. For example, the harness 150 may safely restrain or constrain a child to the apparatus during bouncing or movement.

Thus, the same base 102 and frame 104 may be used for a variety of different activities, and may be used with the same or different seats 120 or 140 as a convertible child activity center.

Figure 5A:
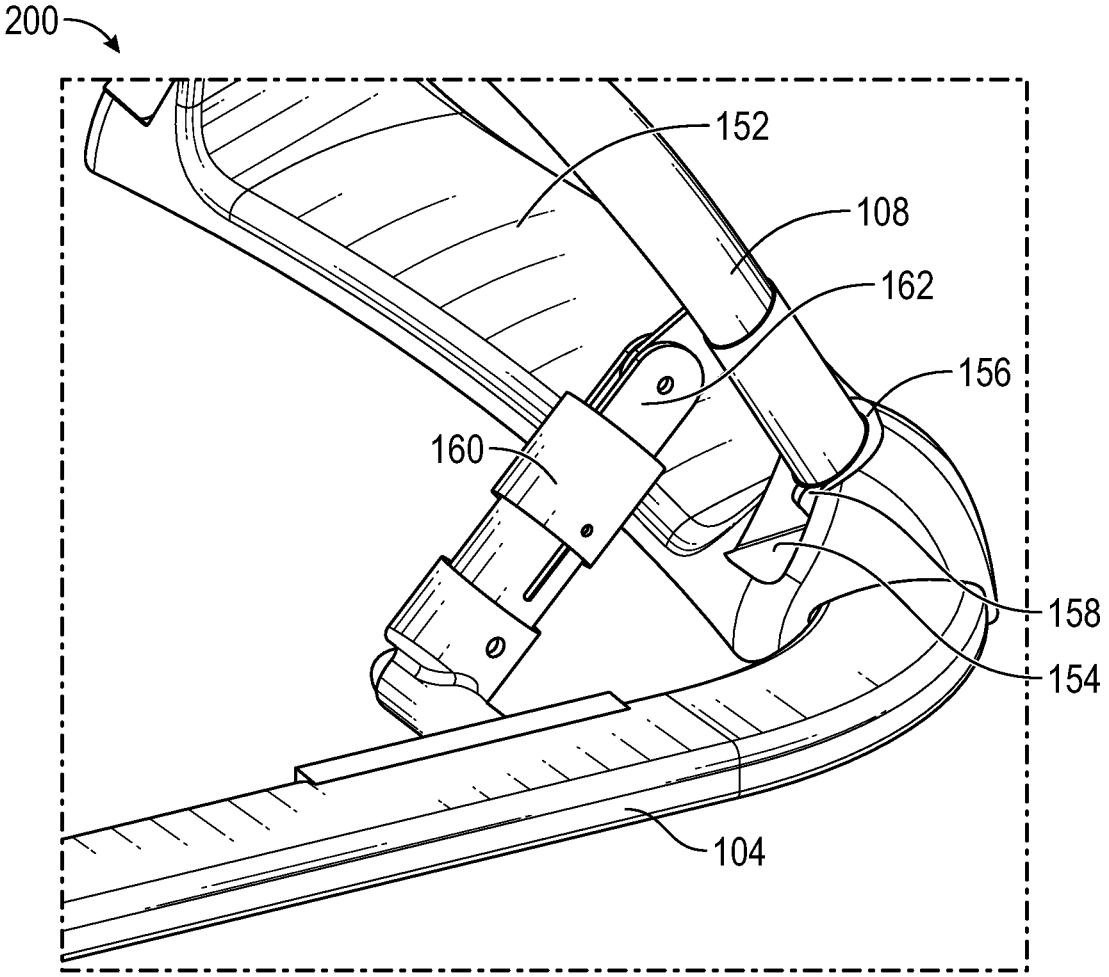
FIG. 5A is a conceptual partial perspective view of a convertible child activity apparatus including a hinge and a pivot bar.
Figure 5C:
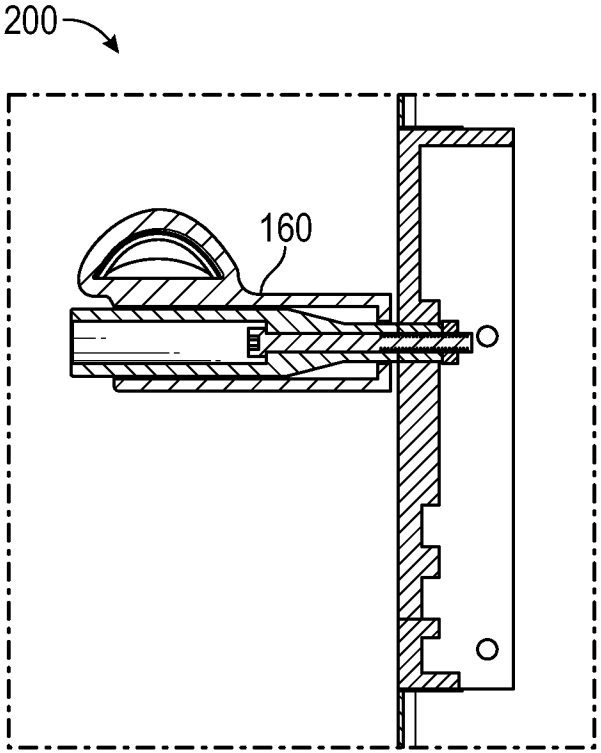
FIG. 5C is a conceptual second partial cross-sectional view of the apparatus of FIG. 5A.
Figure 5B:
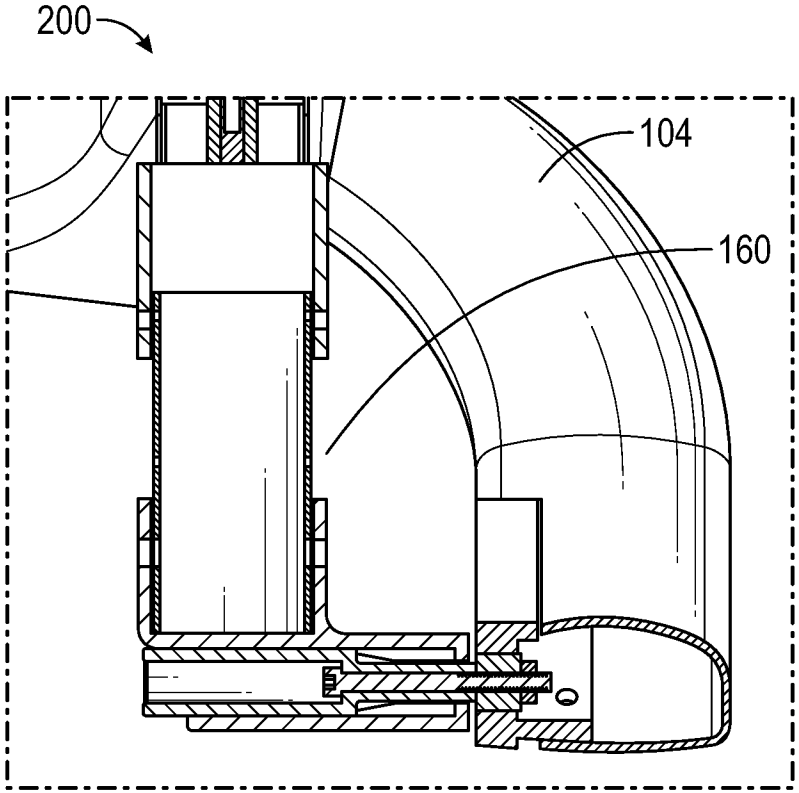
FIG. 5B is a conceptual first partial cross-sectional view of the apparatus of FIG. 5A.

FIG. 5A is a conceptual partial perspective view of a convertible child activity apparatus 200 including a hinge 158 and a pivot bar 160. FIG. 5B is a conceptual first partial cross-sectional view of the apparatus 200 of FIG. 5A. FIG. 5C is a conceptual second partial cross-sectional view of the apparatus 200 of FIG. 5A.

The child activity apparatus 200 may be substantially similar to the apparatus 100, 100*a*, 100*b*, or 100*c* described with reference to FIGS. 1A to 4, and include a similar base 102 secured to the frame 104.

The base 102 further comprises a front housing 152 defining a pair of openings 154 configured to receive the side bars 108. The pair of openings 154 define respective upper walls 156 constraining an angular movement of the side bars 108. Each side bar of the side bars 108 may be rotatably secured to the base 102 by a respective hinge 158.

In some embodiments, each side bar of the side bars 108 is constrained to move within a predetermined angular range of motion by a respective pivot bar 160 secured between the respective side bar and the base 102. In some embodiments, the pivot bar 160 includes a damper. The pivot bar 160 may be secured to the side bar 108 by a pivot hinge 162 (different from the hinge 158). The pivot hinge 162 may accommodate a suitable range of movement and rotation of the pivot bar 160 as the side bars 108 are moved relative to the base 102.

Figure 6A:
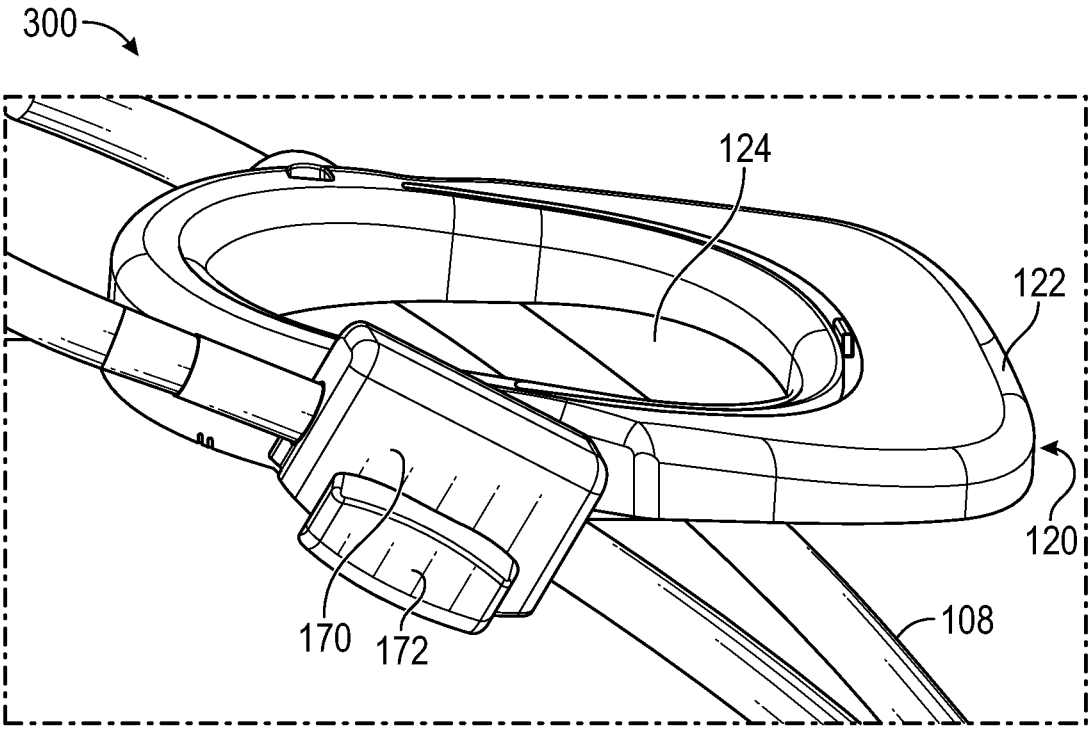
FIG. 6A is a conceptual partial perspective view of a convertible child activity apparatus including a seat tray secured between side bars by a pair of opposed seat pivots.
Figure 6B:
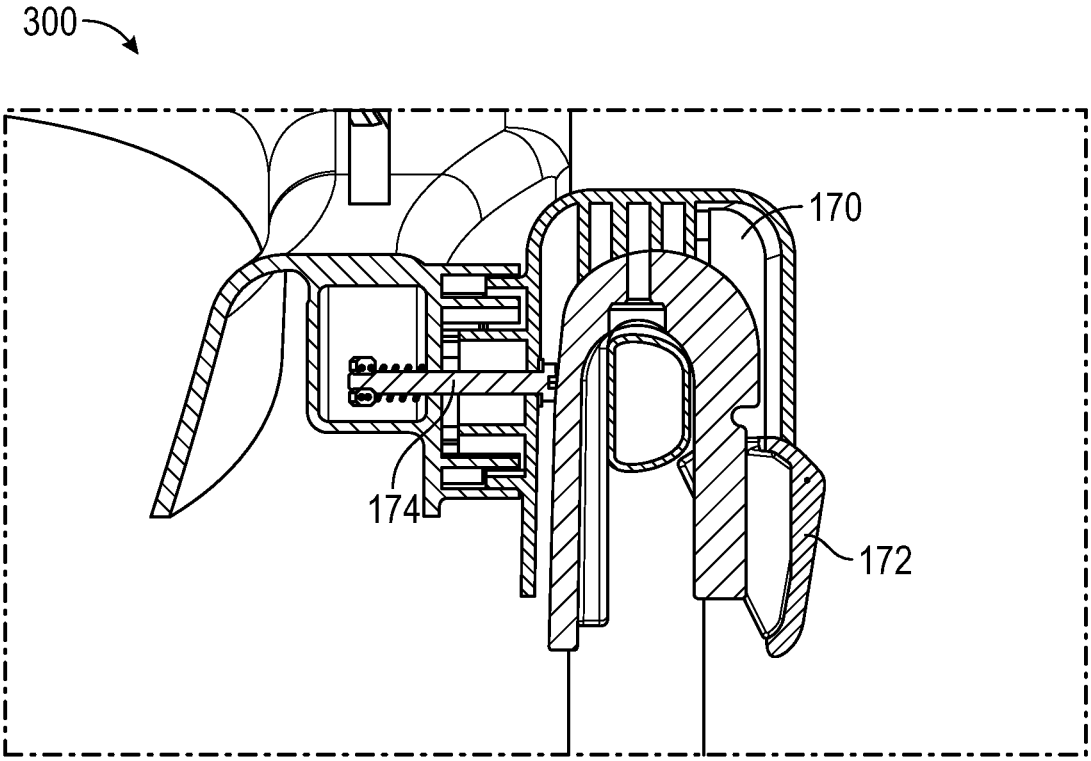
FIG. 6B is a conceptual partial cross-sectional view of the apparatus of FIG. 6A.
Figure 6C:
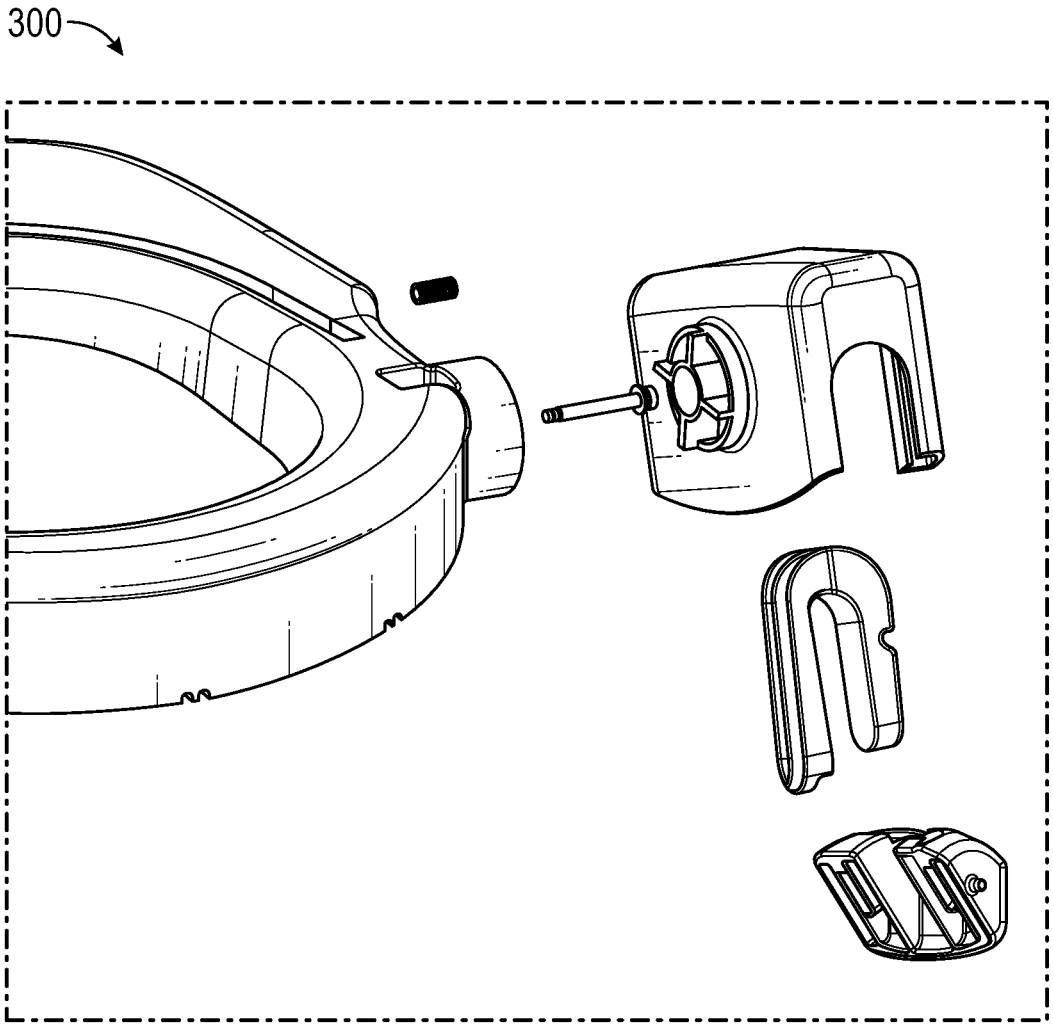
FIG. 6C is a conceptual partial exploded view of the apparatus of FIG. 6A.

FIG. 6A is a conceptual partial perspective view of a convertible child activity apparatus 300 including a seat tray secured between side bars by a pair of opposed seat pivots 170. FIG. 6B is a conceptual partial cross-sectional view of the apparatus 300 of FIG. 6A. FIG. 6C is a conceptual partial exploded view of the apparatus 300 of FIG. 6A. The child activity apparatus 300 may be substantially similar to the apparatus 100, 100*a*, 100*b*, or 100*c* described with reference to FIGS. 1A to 4, or to the apparatus 200 described with reference to FIGS. 5A to 5C, and include a similar base 102 secured to the frame 104 including side bars 108.

As shown in FIG. 6A, the seat 120 (only a seat tray 122 being shown without the seat cover 126) may be secured between side bars 108 by respective seat pivots 170. The seat pivot 170 allow the seat 120 to assume a horizontal position (or any other predetermined orientation) as the side bars 108 are moved relative to the base 102. The seat pivot 170 may include a release button 172 that releases a lock, and allows the seat 120 to be rotated relative to the side bars 108. Thus, the seat 120 may be locked by the seat pivot 170, unless the release button 172 is pressed. When the release button 172 is pressed, the seat pivot may permit the seat 120 to rotate about the pin 174.

FIG. 7A is a conceptual partial side view of an adjustable coupling assembly 400 in a first configuration. The adjustable coupling assembly 400 may be used in any apparatus described with reference to the present disclosure, for securing two components in two relative positions. In the first position 400, the bar 402 is spaced away from the base 404 in a first position. A pin 406 locks the bar 402 relative to the base 404 in the first position.

FIG. 7B is a conceptual partial side view of the assembly 400 of 7A in a second configuration 400*a*. In the second configuration 400*a*, the pin 406 has been released, allowing the base 404 to be moved closer to the bar 402.

FIG. 7C is a conceptual partial side view of the assembly 400 of 7A in a third configuration 400*b*. In the third configuration 400*b*, the relative position of the pin 406 is moved to be ready to lock the bar 402 to the base 404 in a second position.

FIG. 7D is a conceptual partial side view of the assembly 400 of 7A in a fourth configuration 400*c*. In the fourth configuration 400*c*, the pin 406 locks the bar 402 to the base 404 in the second position. These positions can be reversed to reverse the relative position of the bar 402 relative to the base 404.

Figure 8:
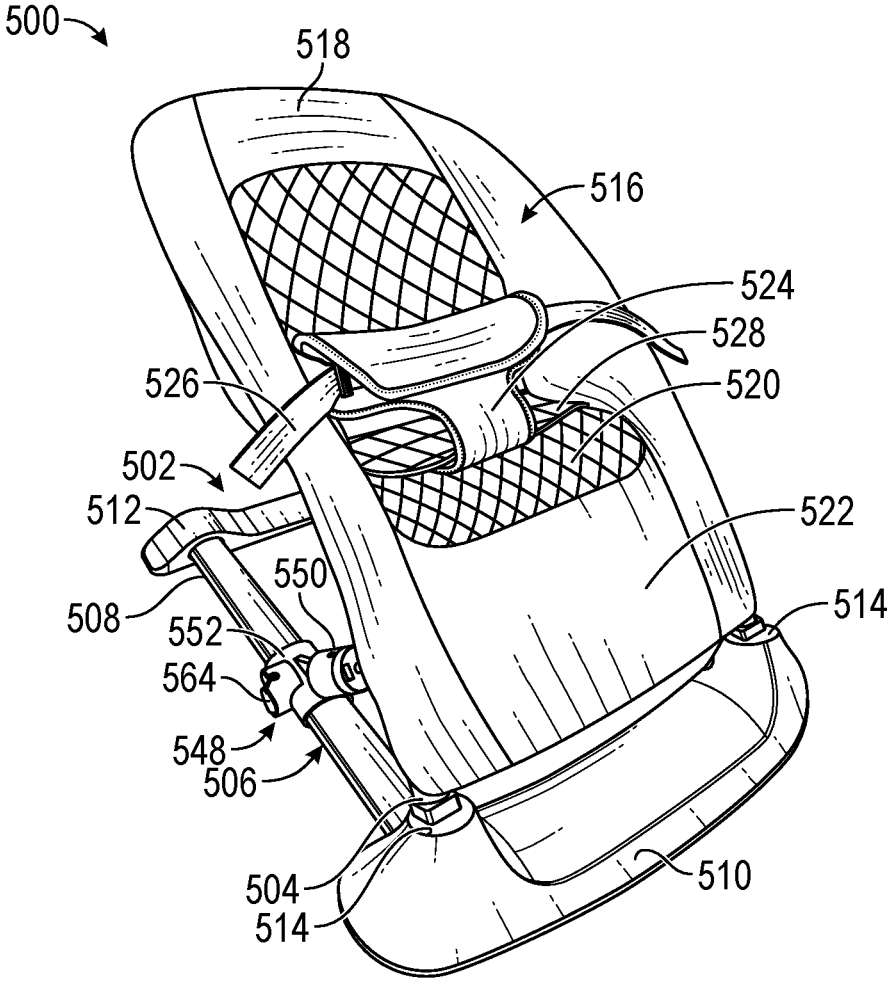
FIG. 8 is a perspective view of the convertible child activity apparatus in an infant mode.

FIG. 8 is a perspective view of the convertible child activity apparatus in infant mode 500. The apparatus 500 may include a frame 502. The frame 502 may include a seat support structure 504 and a base 506. The base 506 may include a pair of opposing side portions 508 coupled between a front portion 510 and a rear portion 512. The seat support structure 504 may be coupled to the front portion 510. The front portion 510 may include a pair of receptacles 514 configured to receive the seat support structure 504. The pair of receptacles 514 may include a first receptacle and a second receptacle.

Figure 15:
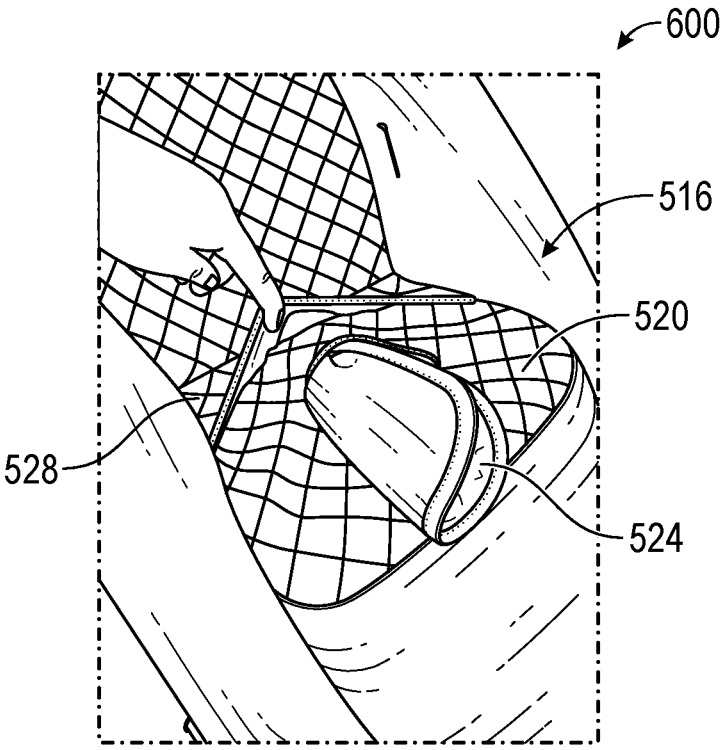
FIG. 15 is a partial-perspective view of the convertible child activity apparatus of FIG. 14.

The convertible child activity apparatus 500 may include a fabric seat insert 516 removably coupled to the seat support structure 504. The fabric seat insert 516 may be configured to define a seat for the child. In one embodiment, the fabric seat insert 516 may be pulled over the seat support structure 504 to define a seat for the child, as shown in FIG. 8. The fabric seat insert 516 may include a back rest portion 518, a seat portion 520, and a leg rest portion 522 to support the feet of a child. The fabric seat insert 516 may include a harness 524 and a child restraint 526, described in greater detail in FIG. 9. A pocket 528 configured to house the harness 524 may be attached to the seat portion 520 of the fabric seat insert 516. The harness 524 may be attached to the seat portion 520 underneath the pocket 528, as shown in FIG. 15.

Figure 9:
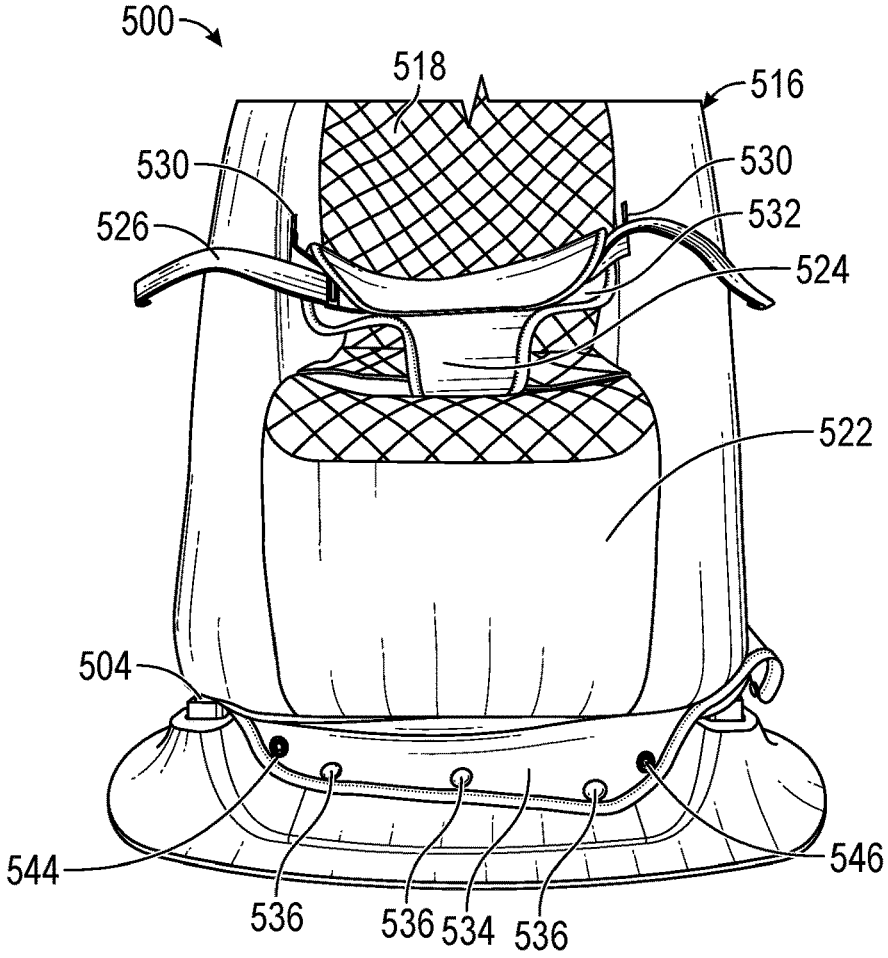
FIG. 9 is a partial front elevation view of the convertible child activity apparatus in FIG. 8.

FIG. 9 is a partial front elevation view of the convertible child activity apparatus 500 in FIG. 8. The convertible child activity apparatus 500 may include a pair of opposing vertical slots 530 on the back rest portion 518 of the fabric seat insert 516. The pair of opposing vertical slots 530 may include a first vertical slot and a second vertical slot. The child restraint 526 may be disposed in the vertical slots 530. The harness 524 may include an opening 532 running laterally through the harness 524 configured to receive the child restraint 526 and extend the child restraint 526 across the fabric seat insert 516. Once the child restraint 526 is secured in the harness 524, the child is safely restrained to the apparatus 500.

The convertible child activity apparatus 500 may include a fabric panel 534 that extends from the bottom of the leg rest portion 522. The fabric panel 534 may include one or more fasteners 536 aligned on the edge of the fabric panel 534 configured to secure the fabric seat insert 516 to the seat support structure 504, as shown in FIG. 10B. The fasteners 536 may be buttons, snaps, or any other suitable fastening mechanism.

Figure 10A:
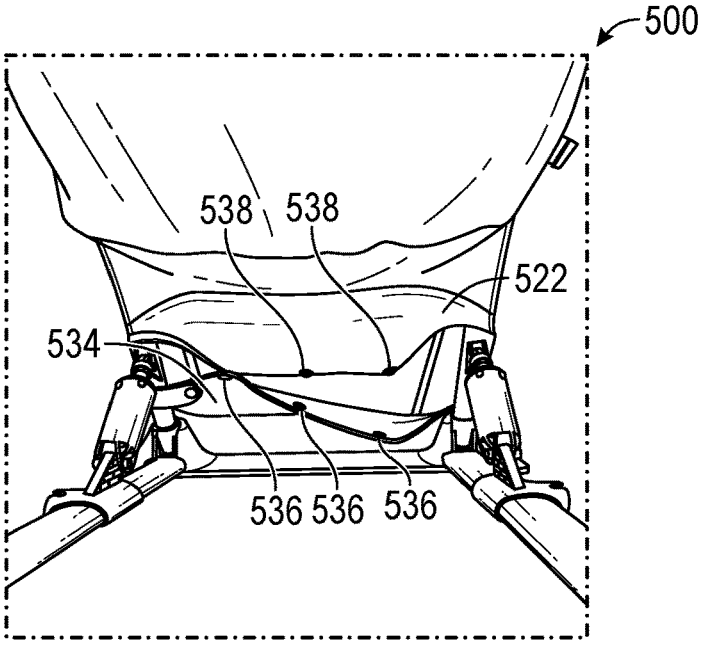
FIG. 10A is a partial rear elevation view of the convertible child activity apparatus in FIG. 8.
Figure 10B:
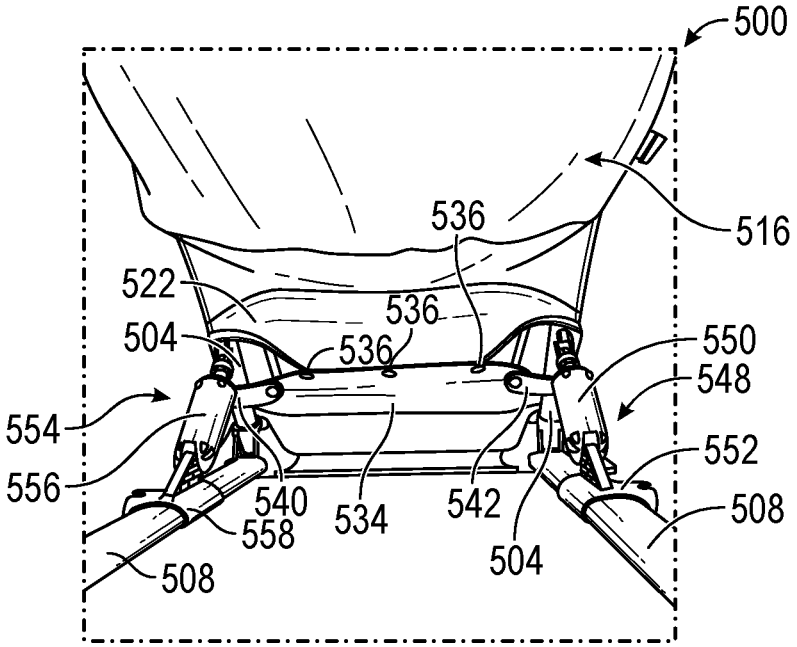
FIG. 10B is a partial rear elevation view of the convertible child activity apparatus in FIG. 8.

FIGS. 10A and 10B are partial rear elevation views of the convertible child activity apparatus 500 in FIG. 8. The convertible child activity apparatus 500 may include one or more fastener receivers 538 on the rear side of the leg rest portion 522 configured to receive the corresponding fastener 536, as shown in FIG. 10B. The fastener receivers 538 may be buttonholes, snaps, clasps, or any other suitable fastener receiving mechanism.

Turning to FIG. 10B, the fabric panel 534 may include a first snap tab 540, a second snap tab 542, a first snap 544 (shown in FIG. 9) configured to receive the first snap tab 540, and a second snap 546 (shown in FIG. 9) configured to receive the second snap tab 542. The first snap tab 540 may wrap around a lower end of the seat support structure 504 and couple to the first snap 544. The second snap tab 542 may wrap around a lower end of the seat support structure 504 and couple to the second snap 546. When the fasteners 536 are coupled to the corresponding fastener receivers 538 and the snap tabs 540, 542 are coupled to the corresponding snaps 544, 546, the fabric seat insert 516 is secured to the seat support structure 504, as shown in FIG. 8.

The convertible child activity apparatus 500 may include a first slider assembly 548. The first slider assembly 548 may include a first actuator 550 and a first sliding mechanism 552. The first actuator 550 may be coupled to the first sliding mechanism 552 and the seat support structure 504, as shown in FIG. 8. The first sliding mechanism 552 may be coupled to the respective side portion 508 and the first actuator 550. The first sliding mechanism 552 may be configured to slide along the side portion 508 from a first predetermined position to a second predetermined position. Instead of the sliding mechanism, any type of adjustment mechanism that moves may be used.

The convertible child activity apparatus 500 may include a second slider assembly 554. The second slider assembly 554 may include a second actuator 556 and a second sliding mechanism 558. The second actuator 556 may be coupled to the second sliding mechanism 558 and the seat support structure 504. The second sliding mechanism 558 may be coupled to the respective side portion 508 and the second actuator 556. The second sliding mechanism 558 may be configured to slide along the side portion 508 from a first predetermined position to a second predetermined position.

Figure 11:
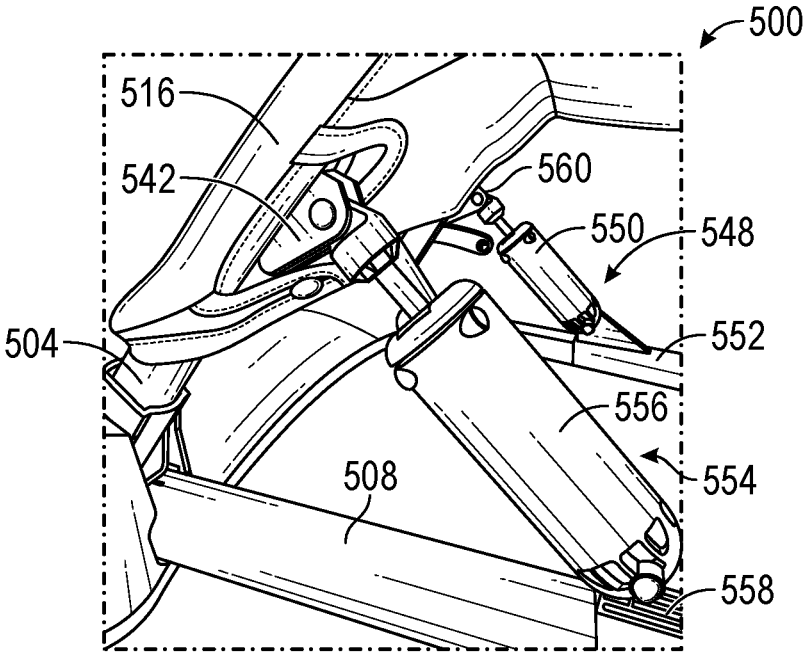
FIG. 11 is a partial perspective view of the convertible child activity apparatus in FIG. 8.

FIG. 11 is a partial perspective view of the convertible child activity apparatus 500 in FIG. 8. The convertible child activity apparatus 500 may include a first hinge 560 configured to couple the first actuator 550 to the seat support structure 504 and a second hinge 562 configured to couple the second actuator 556 to the seat support structure 504, as shown in FIG. 11.

The first actuator 550 may be configured to put the seat support structure 504 in communication with the first sliding mechanism 552. The second actuator 556 may be configured to put the seat support structure 504 in communication with the second sliding mechanism 558. The sliding mechanisms 552, 558 may be configured to move the seat support structure 504 towards the base 506 from a first predetermined position to a second predetermined position. For example, when the sliding mechanisms 552, 558 slide along the respective side portions 508, the seat support structure 504 may move from the first predetermined position to the second predetermined position. The sliding mechanisms 552, 558 may be configured to change the position of the seat support structure with respect to the base when the sliding mechanisms 552, 558 are moved. Changing the position of the seat support structure 504 may include adjusting the height of the seat support structure 504, reclining the seat support structure 504, or positioning the child at different heights with respect to the base 506 by any other means.

Figure 12:
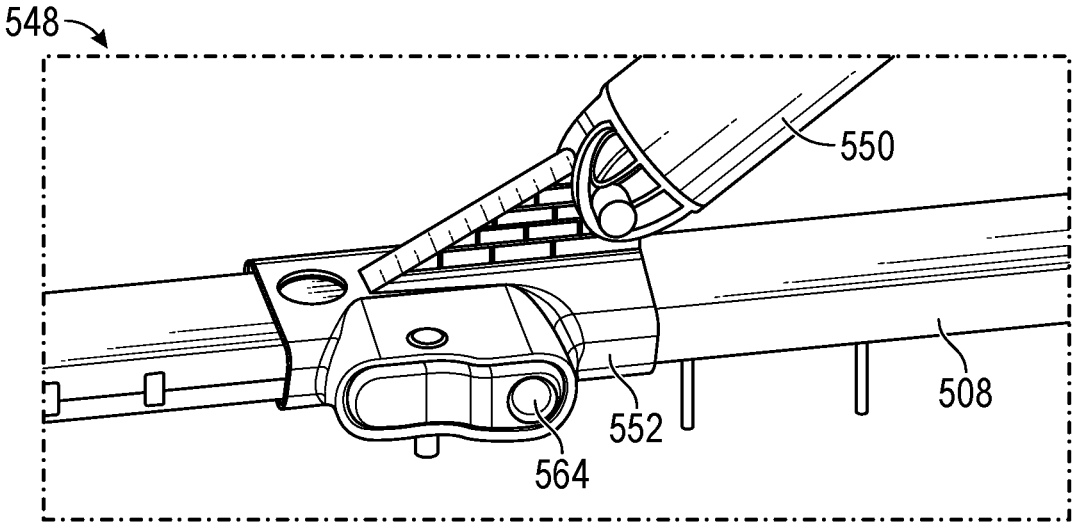
FIG. 12 is a partial side elevation view of a first slider assembly of the convertible child activity apparatus of FIG. 8.

FIG. 12 is a partial side elevation view of the first slider assembly 548 of the convertible child activity apparatus 500 of FIG. 8. Each sliding mechanism 548, 554 may include a push button 564 configured to actuate the respective sliding mechanism 548, 554 to move the seat support structure 504 from a first predetermined position to a second predetermined position, as described in greater detail in FIGS. 13A and 13B.

Figure 13A:
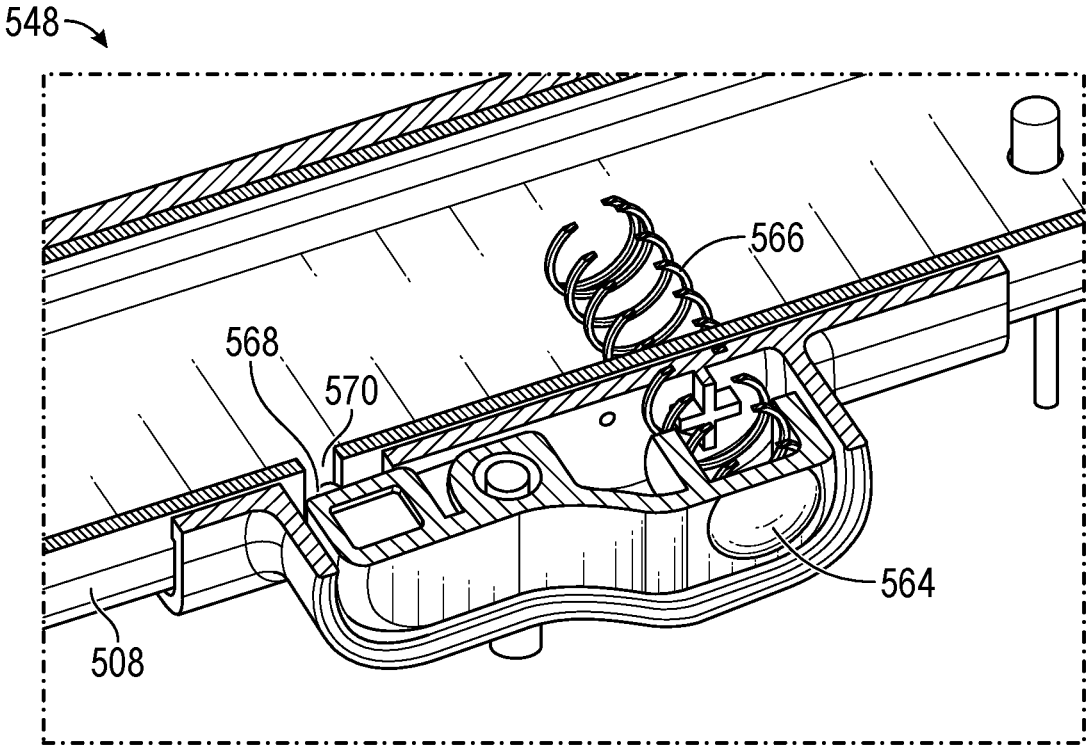
FIG. 13A is an enlarged cross-sectional side view of the first slider assembly of FIG. 12.
Figure 13B:
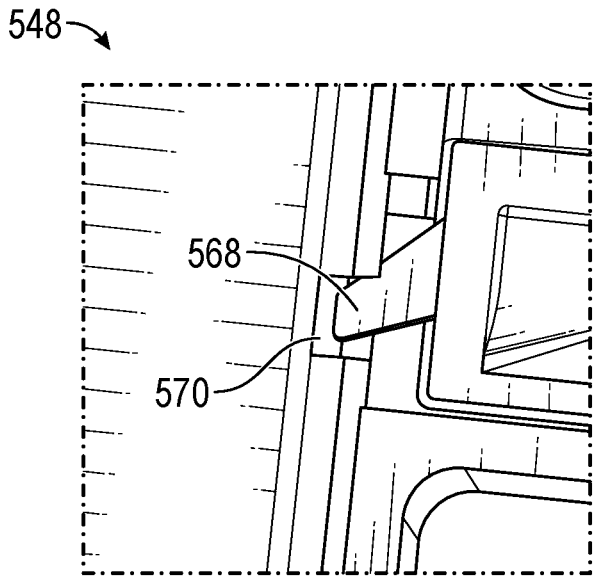
FIG. 13B is an enlarged partial top view of the first slider assembly of FIG. 12.

FIG. 13A is an enlarged cross-sectional side view of the first slider assembly 548 of FIG. 12. FIG. 13B is an enlarged partial top view of the first slider assembly 548 of FIG. 12. The push button 564 may include a spring 566 and a retractable protrusion 568, as shown in FIG. 13A. The base side portions 508 may have a plurality of apertures 570 configured to receive the retractable protrusion 568. The apertures 570 may define the different predetermined positions of the seat support structure 504. When the push button 564 is pressed, the spring 566 may compress and the retractable protrusion 568 may be displaced from the corresponding aperture 570 it was housed in. The sliding mechanisms 552, 558 may then slide into the desired position. When the push button 564 is released, the spring 566 may decompress and the retractable protrusion 568 may be automatically pushed into the corresponding aperture 570 of the desired position, as shown in FIG. 13B.

Figure 14:
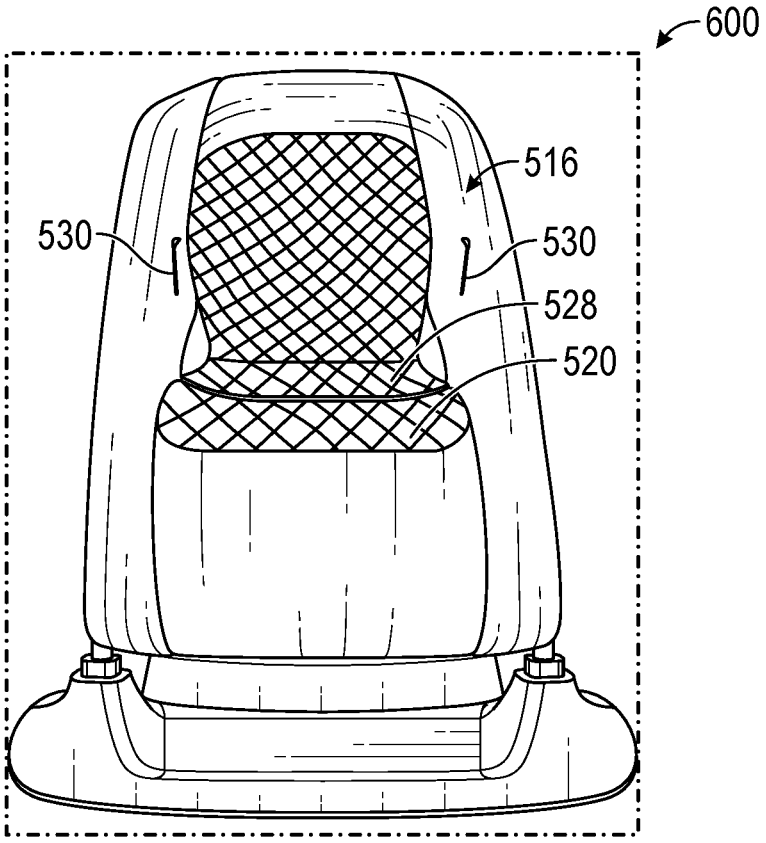
FIG. 14 is a front elevation view of the convertible child activity apparatus of FIG. 8 in a toddler mode.

FIG. 14 is a front elevation view of the convertible child activity apparatus of FIG. 8 in a toddler mode 600.

FIG. 15 is a partial-perspective view of the convertible child activity apparatus 600 of FIG. 14. The pocket 528 attached to the seat portion 520 of the fabric seat insert 516 may be configured to hold the harness 524 when the child activity apparatus is converted from infant mode 500 to toddler mode 600, as shown in FIG. 15.

Figure 16:
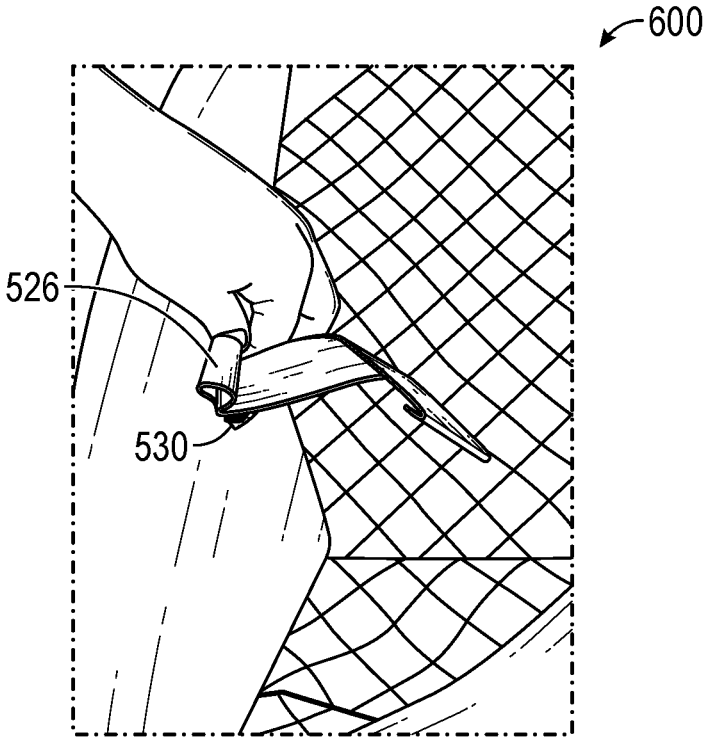
FIG. 16 is a partial front elevation view of the convertible child activity apparatus of FIG. 14.

FIG. 16 is a partial front elevation view of the convertible child activity apparatus 600 of FIG. 14. The pair of opposing vertical slots 530 may be configured to hold the child restraint 526 when the apparatus is converted from infant mode 500 to toddler mode 600, as shown in FIG. 16.

Figure 17:
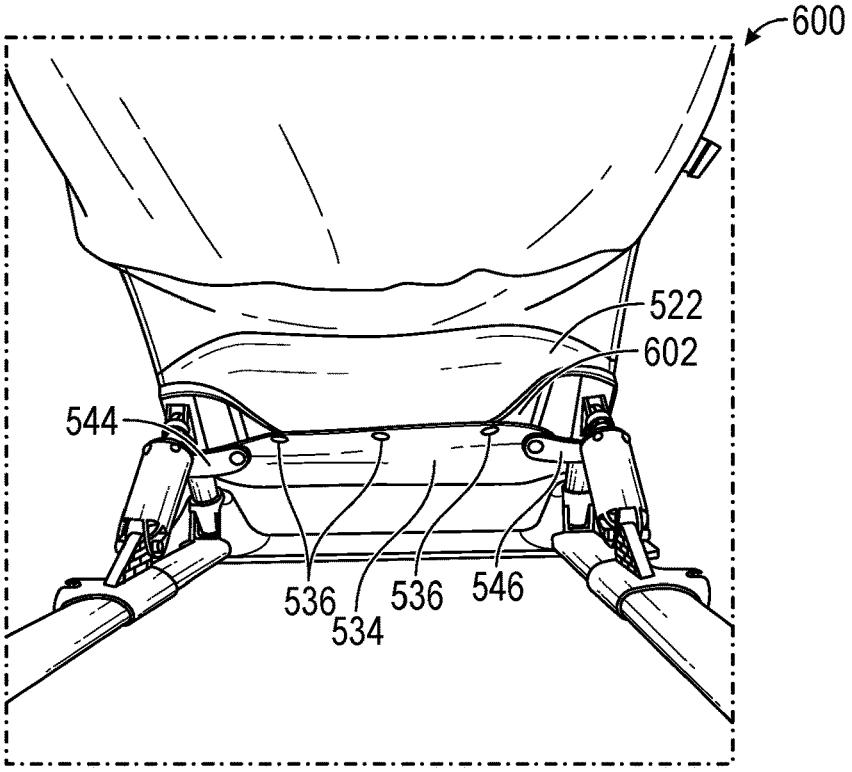
FIG. 17 is a partial rear elevation view of the convertible child activity apparatus of FIG. 14.

FIG. 17 is a partial rear elevation view of the convertible child activity apparatus 600 of FIG. 14. When the fasteners 536 and the snap tabs 544, 546 are secured, a compartment 602 may be defined between the rear side of the leg rest portion 522 and the fabric panel 534. The compartment 602 may be configured to hold the harness 524 and the child restraint 526 when the child activity apparatus is converted to toddler mode 600. For example, when the harness 524 is tucked into the pocket 528 and the child restraint 526 is pushed into the two vertical slots 530, the harness 524 and the child restraint 526 may be disposed in the compartment 602 so that the harness 524 and the child restraint 526 are hidden from view, as shown in FIG. 14.

Figure 18:
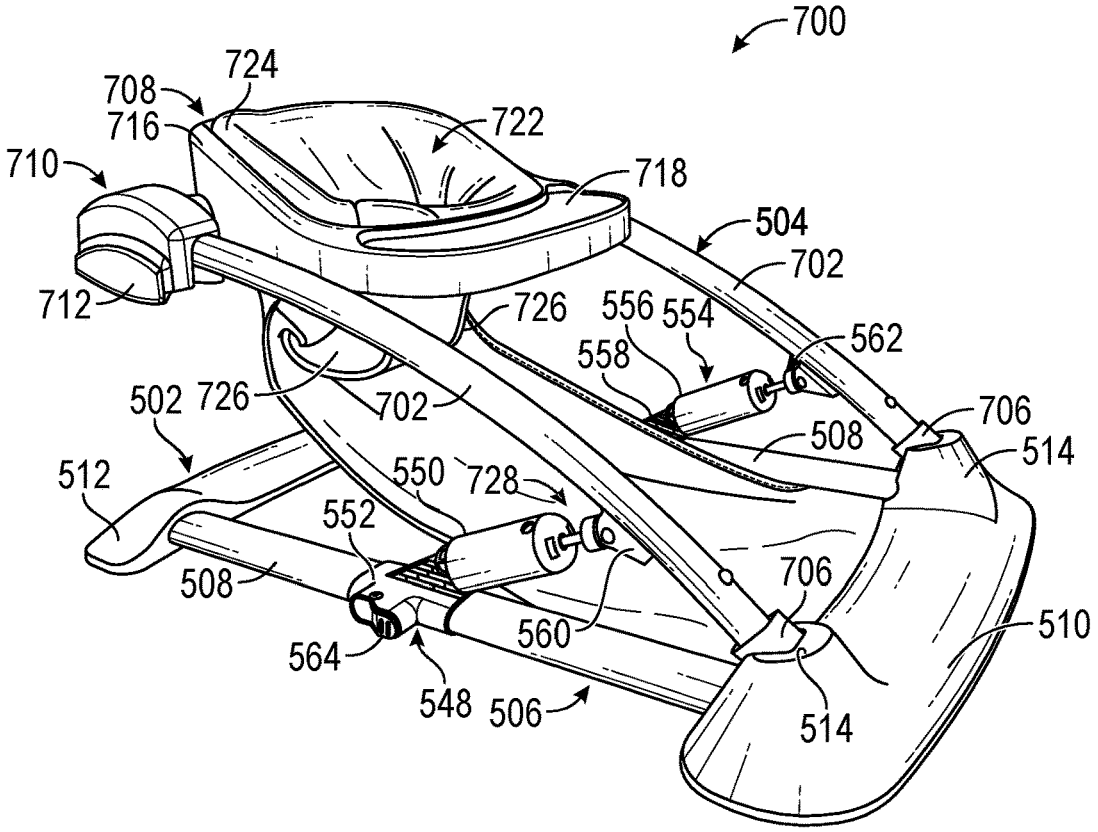
FIG. 18 is a perspective view of the convertible child activity apparatus in a floor seat mode.

FIG. 18 is a perspective view of the convertible child activity apparatus in a floor seat mode 700. The convertible child activity apparatus 700 may include a substantially similar frame 502 to the apparatus 500 or 600 described with reference to FIGS. 8 to 17. The seat support structure 504 of the convertible child activity apparatus 700 may further include a pair of opposing side portions 702 and a horizontal handle 704 extending between the pair of side portions 702 (shown in FIG. A post connector 706 may extend from the end of each side portion 702. The post connector 706 may be configured to extend into the corresponding receptacle 514 of the front portion 510 to couple the seat support structure 504 to the base 506.

The convertible child activity apparatus 700 may include a torso ring 708. The torso ring 708 may be any kind of support structure. The convertible child activity apparatus 700 may include a pair of opposing u-shaped seat pivots 710 removably coupled to the seat support structure 504 that are configured to secure the torso ring 708 in between the side portions 702 of the seat support structure 504. The pair of opposing u-shaped seat pivots 710 may include a first seat pivot and a second seat pivot. The seat pivots 710 may be configured to move the torso ring 708 with respect to the seat support structure 504 to adjust the height of the torso ring 708. Each seat pivot 710 may include a release button 712 that releases a lock when the release button 712 is pressed. When a user pushes and holds the release button 712, the torso ring 708 may be able to move with respect to the seat support structure 504 to adjust the height of the torso ring 708 from a first predetermined height (shown in FIG. 18) to a second predetermined height (shown in FIG. 20). Once the torso ring 708 is in the desired position, the user may disengage the release button 712. Once the release button 712 is released, the lock engages and secures the torso ring 708 in the desired position. The seat pivots 710 may be configured to slide, to remove, or to move the torso ring 708 in any such manner.

The torso ring 708 may include an inner rim 714 (shown in FIG. 24) coupled to an outer rim 716. The outer rim 716 may have a larger diameter than the inner rim 714. A seat tray 718 may be coupled to the outer rim 716 of the torso ring 708. The seat tray 718 may be a toy station or any other attachment. The torso ring 708 and seat tray 718 may define a seat opening 720 (shown in FIG. 24) configured to receive a fabric seat insert 722. The fabric seat insert 722 may be coupled to the inner perimeter wall 724 of the outer rim 716. The fabric seat insert may extend into the seat opening 720 of the torso ring 708 to define a seat for the child. The fabric seat insert 722 may include a pair of leg holes 726 configured to receive the legs of the child. The pair of leg holes 726 may include a first leg hole and a second leg hole.

The convertible child activity apparatus 700 may include a footrest panel 728. The footrest panel 728 may be attached to the back of the fabric seat insert 722. The footrest panel 728 may be removably coupled to the underside of the front portion 510, as described in greater detail with respect to FIGS. 19A and 19B.

Figure 19A:
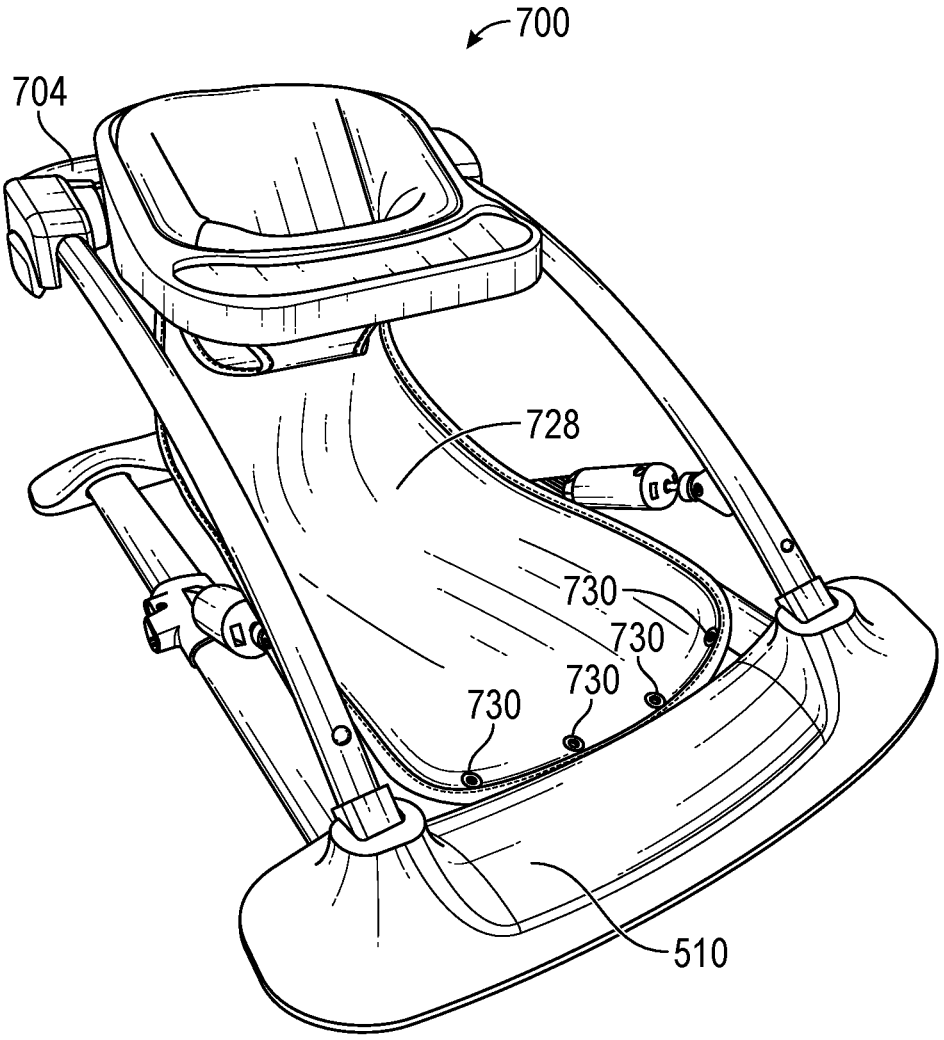
FIG. 19A is a perspective view of the convertible child activity apparatus of FIG. 18.
Figure 19B:
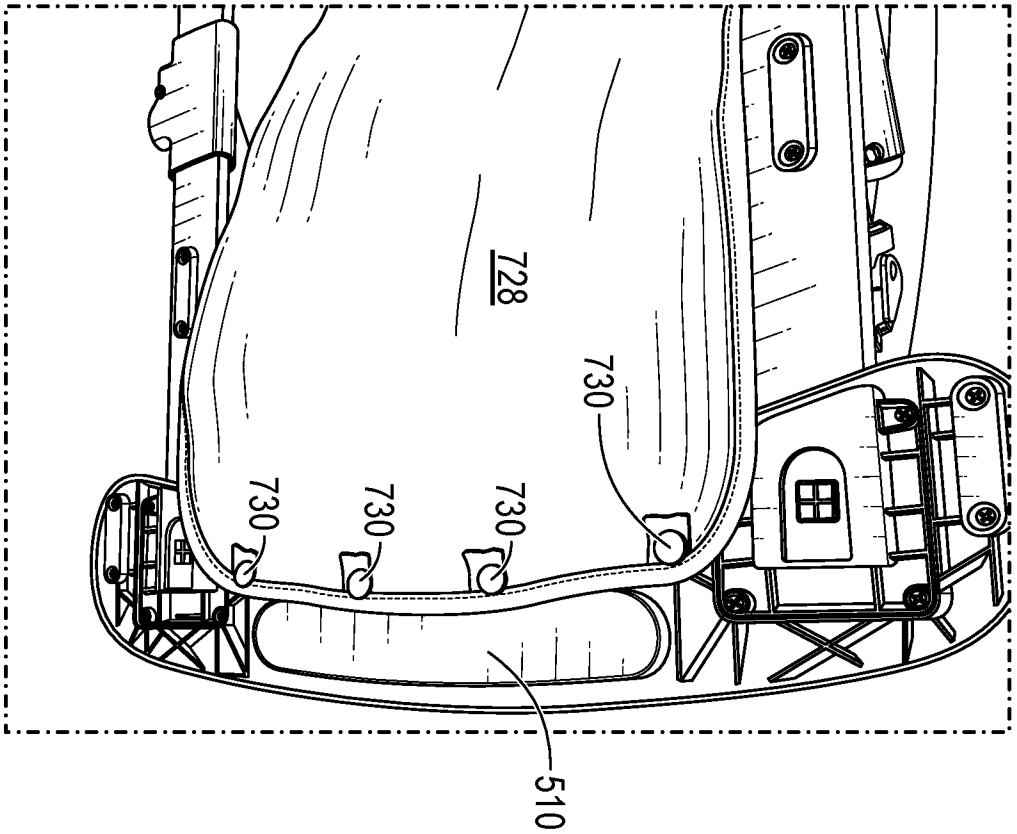
FIG. 19B is a partial bottom elevation view of convertible child activity apparatus of FIG. 18.

FIG. 19A is a perspective view of the convertible child activity apparatus 700 of FIG. 18. FIG. 19B is a partial bottom elevation view of convertible child activity apparatus 700 of FIG. 18.

Referring to FIGS. 19A and 19B, the footrest panel 728 may include a plurality of fasteners 730 configured to secure the footrest panel 728 to the underside of front portion 510. The fasteners 730 may be buttons, snaps, or any other suitable fastening mechanism. When the footrest panel 728 is fastened, the footrest panel 728 is removably coupled to the front portion 510, as shown in FIG. 18.

Figure 20:
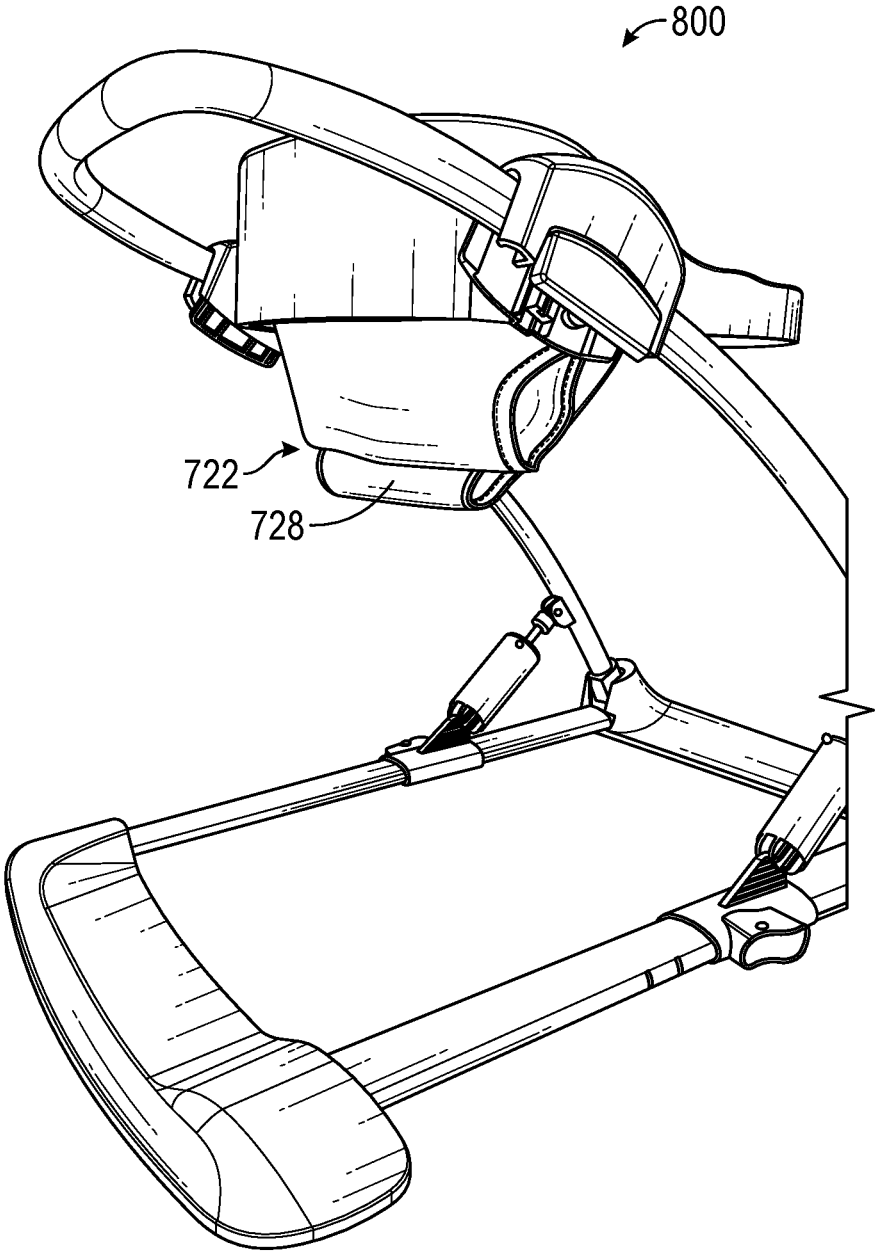
FIG. 20 is a partial perspective view of the convertible child activity apparatus in a jumper mode.

FIG. 20 is a partial perspective view of the convertible child activity apparatus in a jumper mode 800. When converting the apparatus from floor seat mode 700 to jumper mode 800, the footrest panel 728 may be stored in the fabric seat insert 722.

Figure 21:
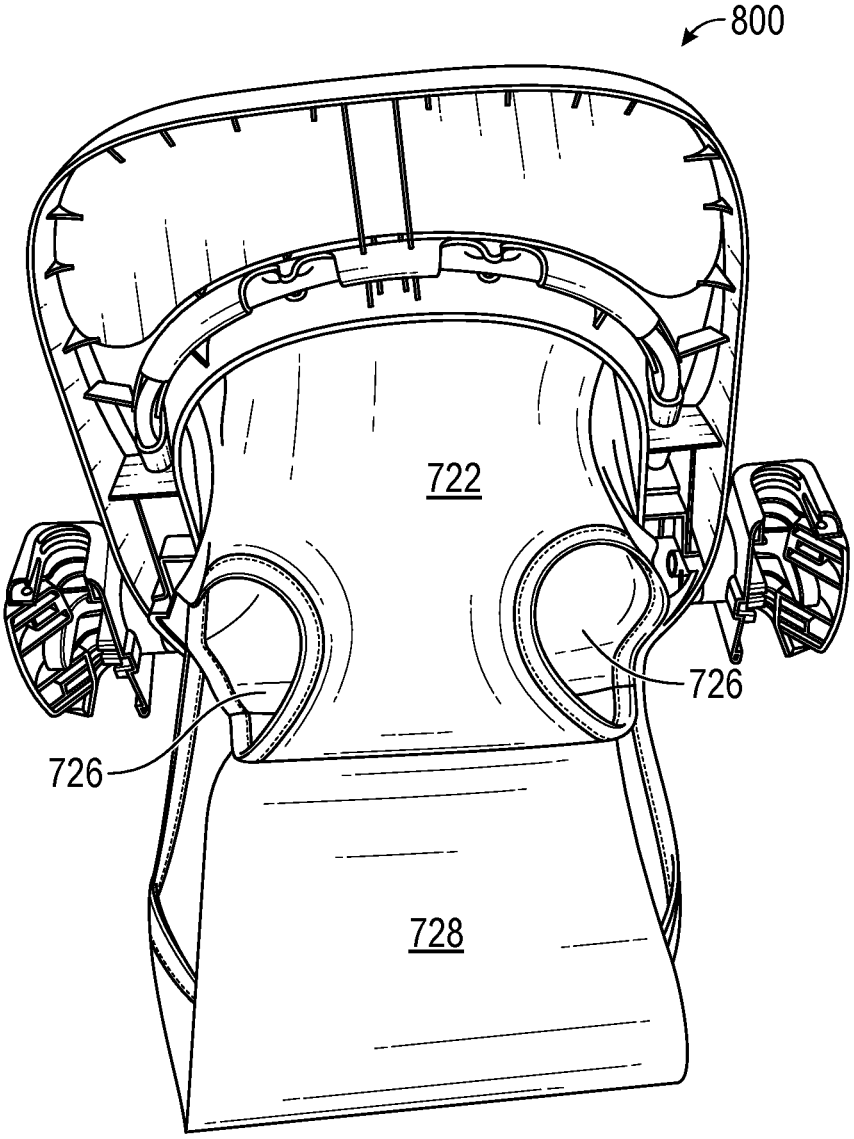
FIG. 21 is a bottom elevation view of the convertible child activity apparatus of FIG. 20.

FIG. 21 is a bottom elevation view of the convertible child activity apparatus 800 of FIG. The fabric seat insert 722 may include a pocket 802 (shown in FIG. 22) configured to receive the footrest panel 728, as shown in FIG. 21.

Figure 22:
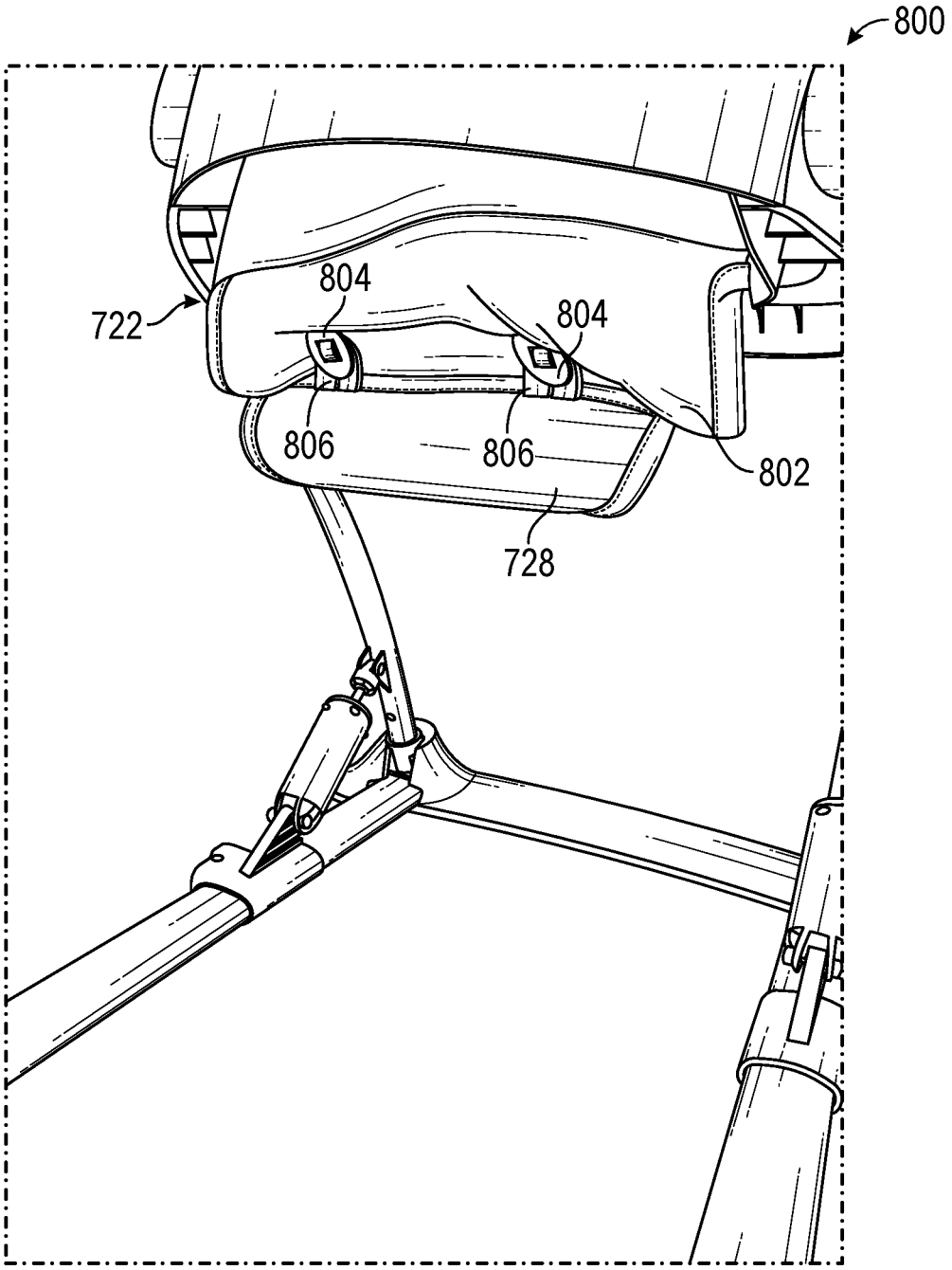
FIG. 22 is a partial rear perspective view of the convertible child activity apparatus of FIG.

FIG. 22 is a partial rear perspective view of the convertible child activity apparatus 800 of FIG. 20. As shown in FIG. 22, the pocket 802 may house a pair of height adjustment buttons 804 configured to secure the footrest panel 728. The pair of height adjustment buttons 804 may include a first height adjustment button and a second height adjustment button. The footrest panel 728 may include a first pair of loops 806 configured to receive the corresponding height adjustment button 804. The first pair of loops 806 may include a first loop and a second loop. When the footrest panel 728 is folded into the pocket 802, the loops 806 may attach to the respective height adjustment button 804 to secure the footrest panel 728 and close the pocket 802.

Figure 23:
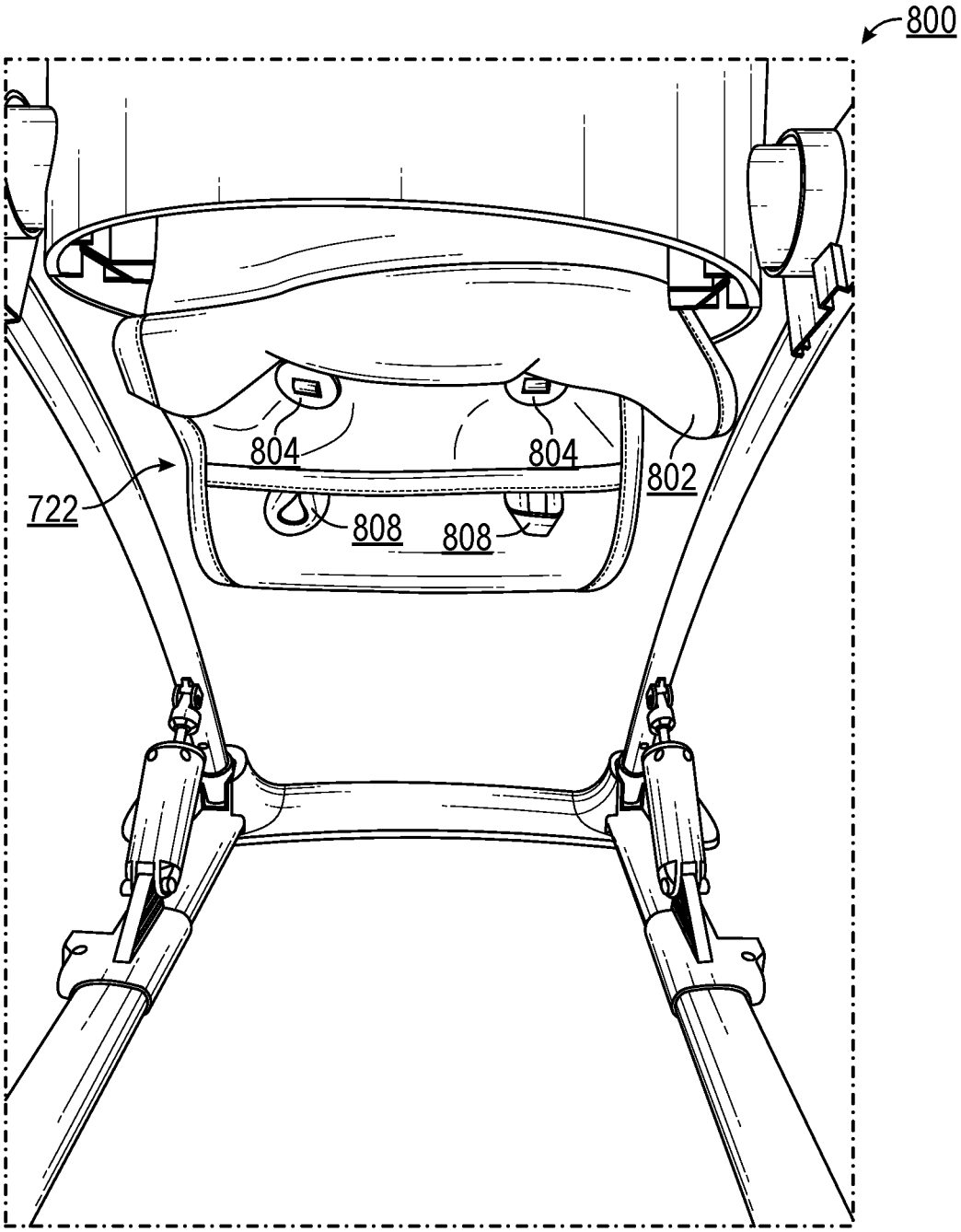
FIG. 23 is a partial rear elevation view of the convertible child activity apparatus of FIG. 20.

FIG. 23 is a partial rear elevation view of the convertible child activity apparatus 800 of FIG. 20. The height adjustment buttons 804 may also be configured to adjust the height of the fabric seat insert 722 relative to the base 506. As shown in FIG. 23, the fabric seat insert 722 may also include a second pair of loops 808 configured to receive the height adjustment buttons 804. The second pair of loops 808 may include a third loop and a fourth loop. Once the footrest panel 728 is secured in the pocket 802, as described with reference to FIG. 22, the user may adjust the height of the fabric seat insert 722 by securing the fabric seat insert loops 808 to the height adjustment buttons 804. Once the fabric seat insert loops 806 are secured to the height adjustment buttons 804, the fabric seat insert 722 may move to a position where the child is higher from the base 506 than when the fabric seat insert loops 808 are detached from the height adjustment buttons 804.

Figure 24:
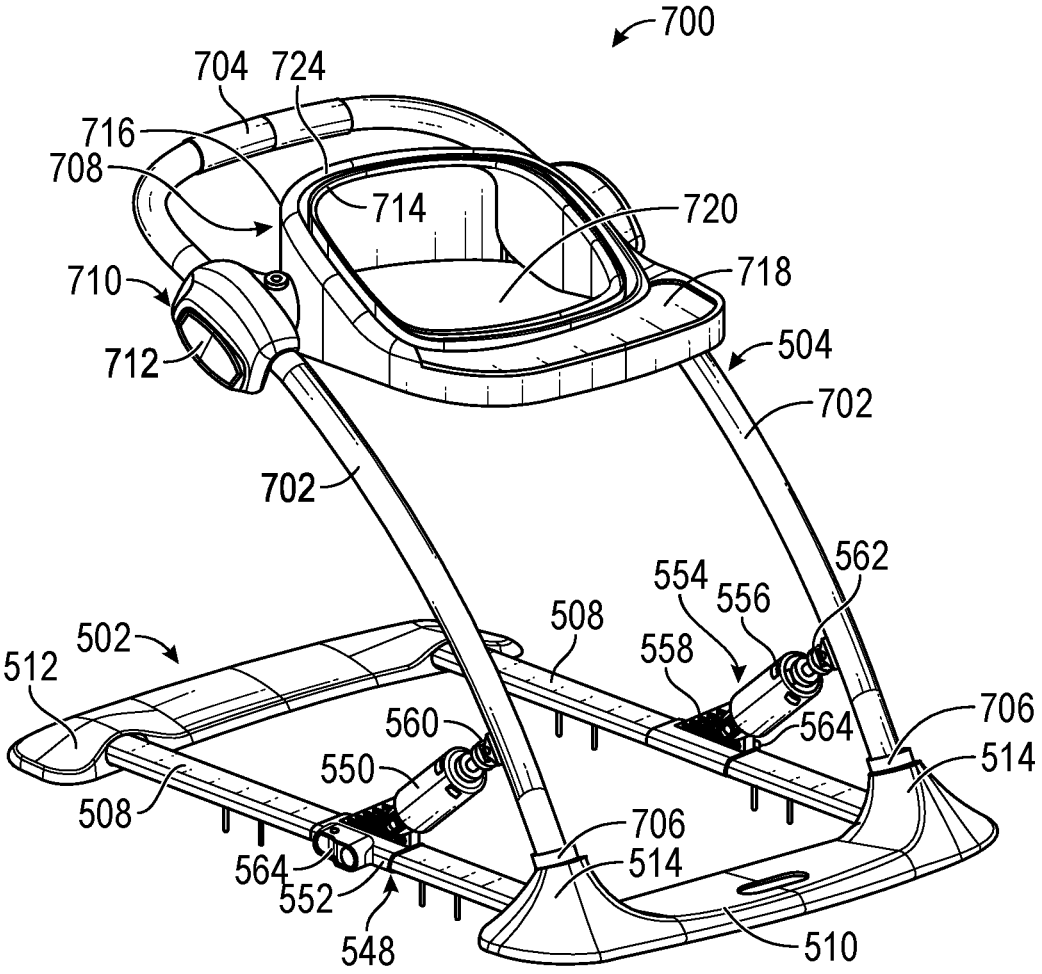
FIG. 24 is a perspective view of the convertible child activity apparatus of FIG. 18.

Turning to FIG. 24, the convertible child activity apparatus 700 of FIG. 18 is shown with the fabric seat insert 722 removed to depict the torso ring 708 in greater detail. The torso ring 708 may be removably coupled to the side portions 702 of the seat support structure 504 by the seat pivots 710. The seat pivots 710 may release the torso ring 708 from the seat support structure 504. Once the torso ring 708 is detached from the seat support structure 504, the convertible child activity apparatus 700 may be converted into the child activity apparatus 500 as described with reference to FIGS. 8 to 13B.

Figure 25:
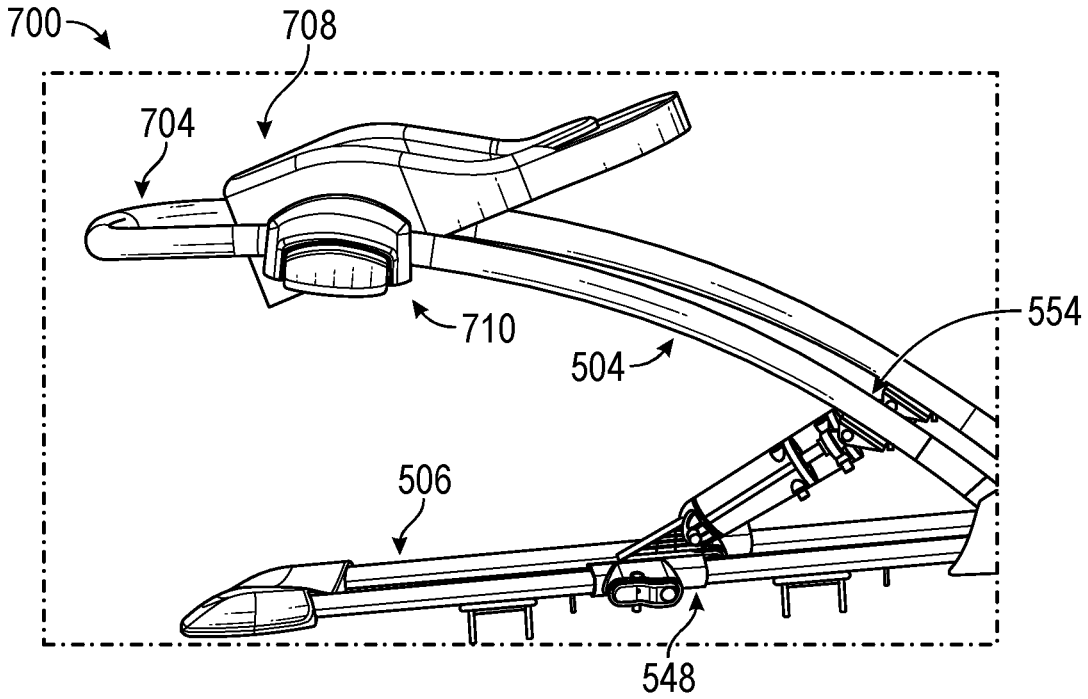
FIG. 25 is a left-side view of the convertible child activity apparatus of FIG. 18.

FIG. 25 is a partial side elevation view of the child activity apparatus 700 of FIG. 24. As shown in FIG. 25, the convertible child activity apparatus 700 may include the sliding assemblies 548, 554 described with respect to FIG. 8. The sliding mechanisms 552, 558 may be configured to move the seat support structure 504 from one predetermined position (shown in FIG. 24) to a second-predetermined position (shown in FIG. 25). As the sliding mechanisms 552, 558 are moved from the first predetermined position to the second predetermined positon, the height of the torso ring 708 can be adjusted relative to the base 506 with the seat pivots 710. For example, as the sliding mechanisms 552, 558 are moved from the first predetermined position to the second predetermined position, the torso ring 708 may be adjusted from a first height (shown in FIG. 24) to a second height (shown in FIG. 25). Therefore, the convertible child activity apparatus 700 may be adjusted to fit children of various heights and sizes.

In embodiments, a method includes securing a seat according to any embodiment to the apparatus according to any embodiment, for example, to a frame thereof. In embodiments, a method may include detaching a prior seat from the apparatus, and securing another seat according to any embodiment to the apparatus. In embodiments, a method includes moving the apparatus of any embodiment between the upper activity position and the lower activity position by rotating the frame relative to the base. In embodiments, a method of assembling the apparatus of any embodiment includes securing the frame to the base. In embodiments, the method further includes securing the seat to the frame.

In embodiments, a kit for a child activity center includes one or more of the frame, the base, and at least one seat according to any embodiment. In embodiments the kit includes a housing or a package including one or more of components described in the present disclosure. In some embodiments, the at least one seat comprises a first seat and a second seat, for example, different seats described with reference to any of FIGS. 1A to 6C.

Though the disclosed examples include particular arrangements of a number of parts, components, features, and aspects, the disclosure is not limited to only those examples or arrangements shown. Any one or more of the parts, components, features, and aspects of the disclosure may be employed alone or in other arrangements of any two or more of the same.

Although certain product features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents.

Unless otherwise noted, the terms used herein are to be understood according to conventional usage by those of ordinary skill in the relevant art. In addition to the definitions of terms provided below, it is to be understood that as used in the specification and in the claims, "a" or "an" may mean one or more, depending upon the context in which it is used.

Throughout this application, the term "include," "include (s)" or "including" means "including but not limited to." Note that certain embodiments may be described relating to a single glass, but the corresponding description should be read to include embodiments of two or more glasses. Different features, variations, and multiple different embodiments are shown and described herein with various details. What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiments or enumerated variations. Many modifications, variations and other embodiments will come to mind of those skilled in the art, and which are intended to be and are in fact covered by this disclosure. It is indeed intended that the scope of this disclosure should be determined by a proper legal interpretation and construction of the disclosure, including equivalents, as understood by those of skill in the art relying upon the complete disclosure present at the time of filing.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

What has been described herein in the present specification and annexed drawings includes examples of systems, apparatuses, methods, devices, and techniques that, individually and in combination, provide for a convertible child activity center. It is, of course, not possible to describe every conceivable combination of components and/or methods for purposes of describing the various elements of the disclosure, but it may be recognized that many further combinations and permutations of the disclosed elements are possible. Accordingly, it may be apparent that various modifications may be made to the disclosure without departing from the scope thereof. In addition, or as an alternative, other embodiments of the disclosure may be apparent from consideration of the specification and annexed drawings, and practice of the disclosure as presented herein. It is intended that the examples put forth in the specification and annexed drawings be considered, in all respects, as illustrative and not limiting. Although specific terms are employed herein, they are used in a generic and descriptive sense only and not for purposes of limitation.

What is claimed is:

1. A convertible child activity apparatus comprising:
- a frame comprising a base and a seat support structure;
- a fabric seat insert removably coupled to the seat support structure, wherein the fabric seat insert comprises:
  - a harness extending across the fabric seat insert, wherein the harness comprises an opening;
  - a child restraint, wherein the child restraint extends through the opening of the harness;
  - a leg rest portion configured to the support the feet of the child in the seat, wherein the leg rest portion comprises one or more fastener receivers; and
  - a fabric panel extending from the leg rest portion;
- a first actuator coupled to a first side of the base and a first side of the seat support structure; and
- a first adjustment mechanism coupled to the first side of the base and the first actuator, wherein the first adjustment mechanism is configured to move along the base from a first predetermined position to a second predetermined position.

2. The convertible child activity apparatus of claim 1, further comprising:
- a second actuator coupled to a second side of the base and a second side of the seat support structure; and
- a second adjustment mechanism coupled to the second side of the base and the second actuator.

3. The convertible child activity apparatus of claim 1, wherein the fabric seat insert defines a seat.

4. The convertible child activity apparatus of claim 1, wherein the
- fabric panel comprises:
  - one or more fasteners;
  - a first snap tab;
  - a first snap;
  - a second snap tab; and
  - a second snap;
- wherein the one or more fastener receivers couple to the one or more fasteners, the first snap tab couples to the first, and the second snap tab couples to the second snap to secure the fabric seat insert to the seat support structure.

5. The convertible child activity apparatus of claim 4, wherein the fabric seat insert further comprises two slots, and wherein the child restraint is disposed in the two slots.

6. The convertible child activity apparatus of claim 4, wherein the fabric seat insert further comprises a pocket, and wherein the harness is disposed in the pocket.

7. The convertible child activity apparatus of claim 4, wherein the fabric panel is configured to secure the fabric seat insert to the seat support structure.

8. The convertible child activity apparatus of claim 4, wherein a compartment is defined between the leg rest portion and the fabric panel in a fastened configuration, and wherein the compartment is configured to store the harness and the child restraint.

9. A system comprising:

a frame comprising a base and a seat support structure;

a fabric seat insert removably coupled to the seat support structure, wherein the fabric seat insert comprises:

a harness extending across the fabric seat insert, wherein the harness comprises an opening;

a child restraint, wherein the child restraint extends through the opening of the harness;

a leg rest portion configured to the support the feet of the child in the seat, wherein the leg rest portion comprises one or more fastener receivers; and a fabric panel extending from the leg rest portion;

a first actuator coupled to a first side of the base and a first side of the seat support structure; and a first adjustment mechanism coupled to the first side of the base and the first actuator, wherein the first adjustment mechanism is configured to move along the base from a first predetermined position to a second predetermined position.

10. The system of claim 9, further comprising:

a second actuator coupled to a second side of the base and a second side of the seat support structure; and a second adjustment mechanism coupled to the second side of the base and the second actuator.

11. The system of claim 9, wherein the fabric seat insert defines a seat.

12. The system of claim 9, wherein the fabric panel comprises:

one or more fasteners;

a first snap tab;

a first snap;

a second snap tab; and a second snap;

wherein the one or more fastener receivers couple to the one or more fasteners, the first snap tab couples to the first, and the second snap tab couples to the second snap to secure the fabric seat insert to the seat support structure.

13. The system of claim 12, wherein the fabric seat insert further comprises two slots, and wherein the child restraint is disposed in the two slots.

14. The system of claim 12, wherein the fabric seat insert further comprises a pocket, and wherein the harness is disposed in the pocket.

15. The system of claim 12, wherein the fabric panel is configured to secure the fabric seat insert to the seat support structure.

16. The system of claim 12, wherein a compartment is defined between the leg rest portion and the fabric panel in a fastened configuration, and wherein the compartment is configured to store the harness and the child restraint.

17. An apparatus comprising:

a frame comprising a base and a seat support structure;

a fabric seat insert removably coupled to the seat support structure, wherein the fabric seat insert comprises:

a harness extending across the fabric seat insert, wherein the harness comprises an opening;

a child restraint, wherein the child restraint extends through the opening of the harness;

a leg rest portion configured to the support the feet of the child in the seat, wherein the leg rest portion comprises one or more fastener receivers; and a fabric panel extending from the leg rest portion;

a first actuator coupled to a first side of the base and a first side of the seat support structure; and a first adjustment mechanism coupled to the first side of the base and the first actuator, wherein the first adjustment mechanism is configured to move along the base from a first predetermined position to a second predetermined position.

* * * * *